US011353810B2

(12) United States Patent
Nagashima

(10) Patent No.: US 11,353,810 B2
(45) Date of Patent: Jun. 7, 2022

(54) FIXING DEVICE HAVING CHARGEABLE POWER SOURCE, SWITCHING ELEMENT AND IMAGE FORMING APPARATUS

(71) Applicant: CANON KABUSHIKI KAISHA, Tokyo (JP)

(72) Inventor: Satoru Nagashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/322,806

(22) Filed: May 17, 2021

(65) Prior Publication Data

US 2021/0364953 A1 Nov. 25, 2021

(30) Foreign Application Priority Data

May 21, 2020 (JP) ..... JP2020-088952

(51) Int. Cl.

| | |
|---|---|
| ***G03G 15/20*** | (2006.01) |
| ***G03G 15/00*** | (2006.01) |
| ***H05B 1/02*** | (2006.01) |

(52) U.S. Cl.

CPC ..... *G03G 15/2039* (2013.01); *G03G 15/5004* (2013.01); *H05B 1/0241* (2013.01); *G03G 15/205* (2013.01)

(58) Field of Classification Search

CPC ..... G03G 15/2039; G03G 15/5004; H05B 1/0241

USPC ..... 399/69, 88, 329, 330; 219/216, 507, 510

See application file for complete search history.

(56) References Cited

U.S. PATENT DOCUMENTS

| | | | | |
|---|---|---|---|---|
| 7,949,885 | B2 * | 5/2011 | Kikuchi | G06F 1/305 713/300 |
| 8,958,713 | B2 * | 2/2015 | Inukai | H02M 1/083 399/88 |
| 10,969,727 | B2 | 4/2021 | Nagashima | G03G 15/2039 |
| 2013/0148998 | A1 * | 6/2013 | Shimura | G03G 15/80 399/88 |
| 2020/0096920 | A1 * | 3/2020 | Ishikawa | G03G 15/80 |
| 2020/0292981 | A1 * | 9/2020 | Nagashima | G03G 15/80 |
| 2020/0341411 | A1 * | 10/2020 | Kunimori | G03G 15/80 |
| 2021/0011410 | A1 * | 1/2021 | Oi | G03G 15/5004 |

FOREIGN PATENT DOCUMENTS

| | | |
|---|---|---|
| EP | 1339053 | 8/2002 |
| JP | 2001-326087 | 11/2001 |
| JP | 2002-247758 | 8/2002 |
| JP | 6152618 B | 4/2015 |

* cited by examiner

*Primary Examiner* — Robert B Beatty
(74) *Attorney, Agent, or Firm* — Venable LLP

(57) ABSTRACT

A fixing device includes a heater, a switching element, a zero-cross detecting portion, a controller, a power source, a driving portion. In a case that an amount of electric charge charged in the power source is predetermined value or more, the controller outputs a first signal to the driving portion so that a time in which a current is passed from the power source to the switching element is a first time. In a case that the amount of the electric charge is less than the predetermined value, the controller outputs a second signal to the driving portion so that the time in which the current is passed from the power source to the switching element is a second time shorter than the first time.

10 Claims, 12 Drawing Sheets

| VALUE | CURRENT WAVEFORM SUPPLIED TO HEATER 54 |
|---|---|
| 1 |  |
| 0 |  |
| -1 |  |

FIXING DEVICE HAVING CHARGEABLE POWER SOURCE, SWITCHING ELEMENT AND IMAGE FORMING APPARATUS

FIELD OF THE INVENTION AND RELATED ART

The present invention relates to a fixing device and an image forming apparatus and particularly relates to control of the fixing device mounted in the image forming apparatus such as a copying machine or a laser beam printer.

There is a technique, as disclosed in Japanese Laid-Open Patent Application (JP-A) 2002-247758, such that in a circuit in which electric power is supplied from an AC voltage source (power source) to a load by controlling a switching element such as a bidirectional thyristor (hereinafter, referred to as a triac), a voltage source different from the AC voltage source is provided and the triac is controlled by passing a gate current through the triac. On the other hand, it has been known that due to distortion of an AC voltage of the AC voltage source and superposed noise, the triac turns off. As a method in which the triac is prevented from turning off and is controlled, as disclosed in JP-A 2001-32687, there is a technique such that in order to substantially continuously bring the triac into conduction, control is carried out so that a minus (−) potential is continuously supplied to a voltage source. Further, as disclosed in Japanese Patent 6152618, a technique such that an application time of a gate signal is increased has been proposed.

As in a conventional circuit in which the voltage source is provided separately from the AC voltage source and in which the gate current is passed and the triac is controlled, for continuously applying the potential to the voltage source in order to substantially continuously bring the triac into conduction, a circuit element such as a transformer or a bridge diode is needed. Further, in the circuit in which the voltage source is provided separately from the AC voltage source and in which the gate current is passed and the triac is controlled, when countermeasure against the turning-off of the triac due to the distortion of the voltage source and the noise is intended to be taken by prolonging a time in which the gate current is passed, a large voltage source capacity is needed. For this reason, in a circuit in which the switching element is controlled by the voltage source other than the AC voltage source, it has been required that the switching element is continuously controlled by a simple means while suppressing an increase in cost and while avoiding the influence due to the distortion of the AC voltage source and the noise.

SUMMARY OF THE INVENTION

According to an aspect of the present invention, there is provided a fixing device comprising: a heater; a switching element configured to switch a state thereof between a conduction state in which electric power is supplied from an AC voltage source to the heater and a non-conduction state in which supply of the electric power is interrupted; a zero-cross detecting portion configured to detect a zero-cross point of an AC voltage supplied from the AC voltage source; a controller configured to control the switching element to the conduction state or the non-conduction state on the basis of a detection result of the zero-cross detecting portion; a power source chargeable by the electric power supplied from the AC voltage source and configured to supply, to the switching element, a current for changing the state of the switching element from the non-conduction state to the conduction state; and a driving portion configured to change the state of the switching element to the non-conduction state by supplying the current from the power source to the switching element depending on a signal outputted from the controller, wherein in a case that an amount of electric charge charged in the power source is predetermined value or more, the controller outputs a first signal to the driving portion so that a time in which a current is passed from the power source to the switching element is a first time, and in a case that the amount of the electric charge is less than the predetermined value, the controller outputs a second signal to the driving portion so that the time in which the current is passed from the power source to the switching element is a second time shorter than the first time.

Further features of the present invention will become apparent from the following description of exemplary embodiments with reference to the attached drawings.

DESCRIPTION OF THE EMBODIMENTS

In the following, embodiments for carrying out the present invention will be described specifically with reference to the drawings.

Embodiment 1

[Image Forming Apparatus]

Figure 1:
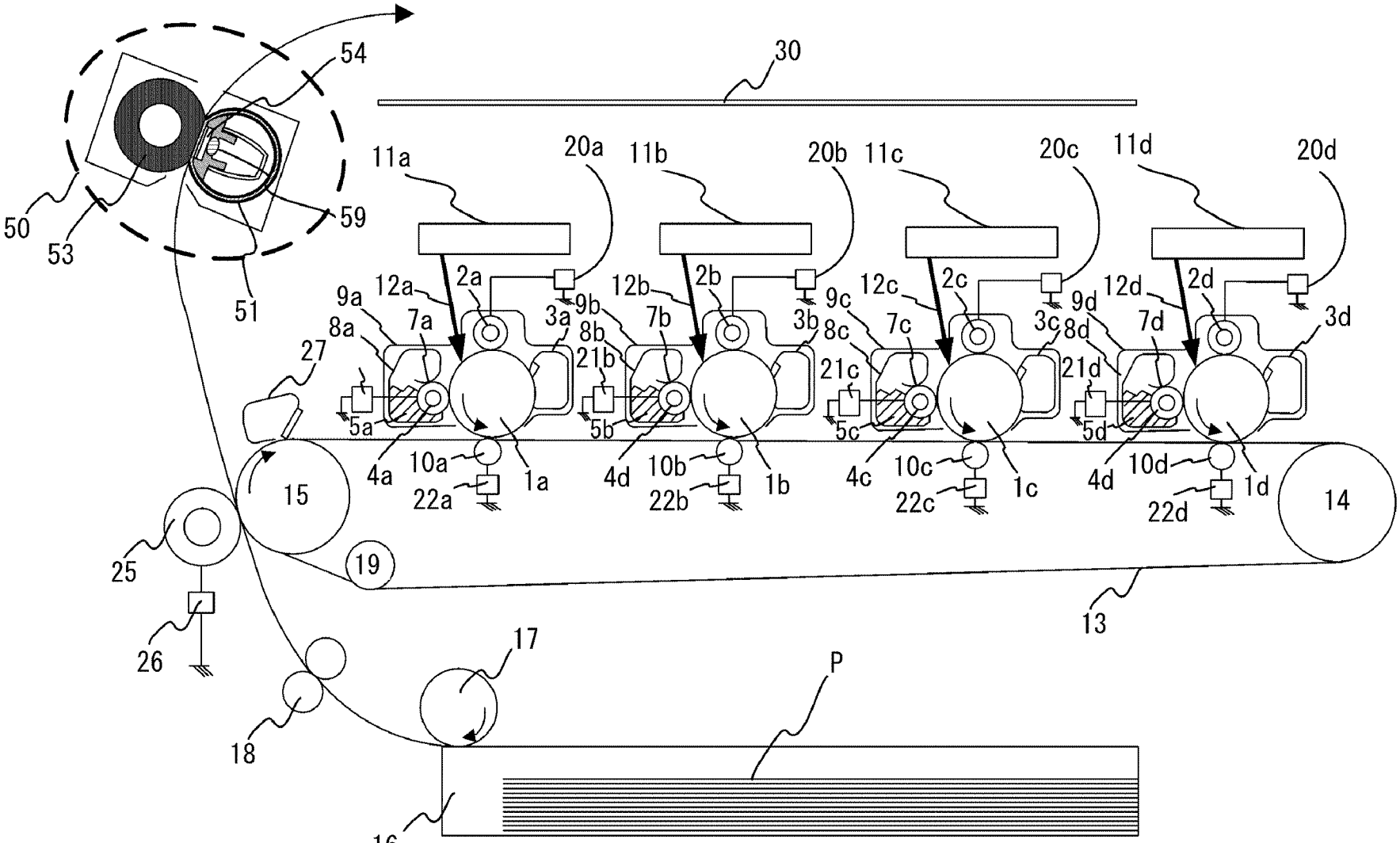
FIG. 1 is a schematic view showing a general structure of an image forming apparatus according to embodiments 1-3.

FIG. 1 is a schematic structural view showing an in-line color image forming apparatus which is an example of an image forming apparatus in which a fixing device according to an embodiment 1 is mounted. An operation of the color image forming apparatus of an electrophotographic type will be described using FIG. 1. Incidentally, a first station is a station for forming a toner image of yellow (Y), and a second station is a station for forming a toner image of magenta (M). Further, a third station is a station for forming a toner image of cyan (C), and a fourth station is a station for forming a toner image of black (K).

In the first station, a photosensitive drum 1*a* which is an image bearing member is an OPC photosensitive drum. The photosensitive drum 1*a* comprises a plurality of lamination layers of functional organic materials, including a carrier generating layer for generating electric charges on a metal cylinder through light exposure and a charge transporting layer for transporting the generated electric charges, and the like layer, and an outermost layer is low in electrical conductivity and is substantially insulative. A charging roller 2*a* which is a charging means is contacted to the photosensitive drum 1*a* and electrically charges a surface of the photosensitive drum 1*a* while being rotated by the photosensitive drum 1*a* with rotation of the photosensitive drum 1*a*. To the charging roller 2*a*, a voltage biased with a DC voltage or an AC voltage is applied, so that the photosensitive drum 1*a* is electrically charged by generation of electric discharge from a nip between the surfaces of the charging roller 2*a* and the photosensitive drum 1*a* in minute air gaps on sides upstream and downstream of the nip with respect to a rotational direction. A cleaning unit 3*a* is a unit for removing toner remaining on the photosensitive drum 1*a* after transfer, as described later. A developing unit 8*a* which is a developing means includes a developing roller 4*a*, non-magnetic one-component toner 5*a*, and a developer application blade 7*a*. The photosensitive drum 1*a*, the charging roller 2*a*, the cleaning unit 3*a*, and the developing unit 8*a* constitute an integral process cartridge 9*a* mountable in and dismountable from the image forming apparatus.

An exposure device 11*a* which is an exposure means is constituted by a scanner unit or a light emitting diode (LED) array for scanning the photosensitive drum surface with laser light through a polygonal mirror, and the surface of the photosensitive drum 1*a* is irradiated with a scanning beam 12*a* modulated on the basis of an image signal. Further, the charging roller 2*a* is connected to a charging high-voltage source 20*a* which is a voltage supplying means to the charging roller 2*a*. The developing roller 4*a* is connected to a developing high-voltage source 21*a* which is a voltage supplying means to the developing roller 4*a*. A primary transfer roller 10*a* is connected to a primary transfer high-voltage source 22*a* which is a voltage supplying means to the primary transfer roller 10*a*. The above is a constitution of the first station, and the second to fourth stations have similar constitutions. As regards the second to fourth (other) stations, component elements having the same functions as those in the first station are represented by the same reference numerals, and associated suffixes b, c and d are added to the reference numerals for the respective stations. Incidentally, in the following description, the suffixes a, b, c, and d will be omitted except for the case where specific station is described.

An intermediary transfer belt 13 is supported by three rollers, as stretching members therefor, consisting of a secondary transfer opposite roller 15, a tension roller 14, and an auxiliary roller 19. To only the tension roller 14, a force in a direction in which the intermediary transfer belt 13 is stretched is applied by a spring (not shown), so that proper tension applied to the intermediary transfer belt 13 is maintained. The secondary transfer opposite roller 15 is rotated by receiving rotational drive from a main motor (not shown), so that the intermediary transfer belt 13 is rotated. The intermediary transfer belt 13 is moved in the same direction (for example, the clockwise direction in FIG. 1) for the photosensitive drums 1*a* to 1*d* (for example, rotate in the countereclockwise direction in FIG. 1) substantially at the same speed. Further, the intermediary transfer belt 13 is rotated in an arrow direction (the clockwise direction), and the primary transfer roller 10 is disposed opposite from the photosensitive drum 1 while sandwiching the intermediary transfer belt 13 therebetween. A position where the photosensitive drum 1 contacts the intermediary transfer belt 13 toward the primary transfer roller 10 is a primary transfer position. The auxiliary roller 19, the tension roller 14 and the secondary transfer opposite roller 15 are electrically grounded. Incidentally, primary transfer rollers 10*b* to 10*d* of the second to fourth stations also have constitutions similar to the constitution of the primary transfer roller 10*a* of the first station, and therefore, will be omitted from description.

Figure 2:
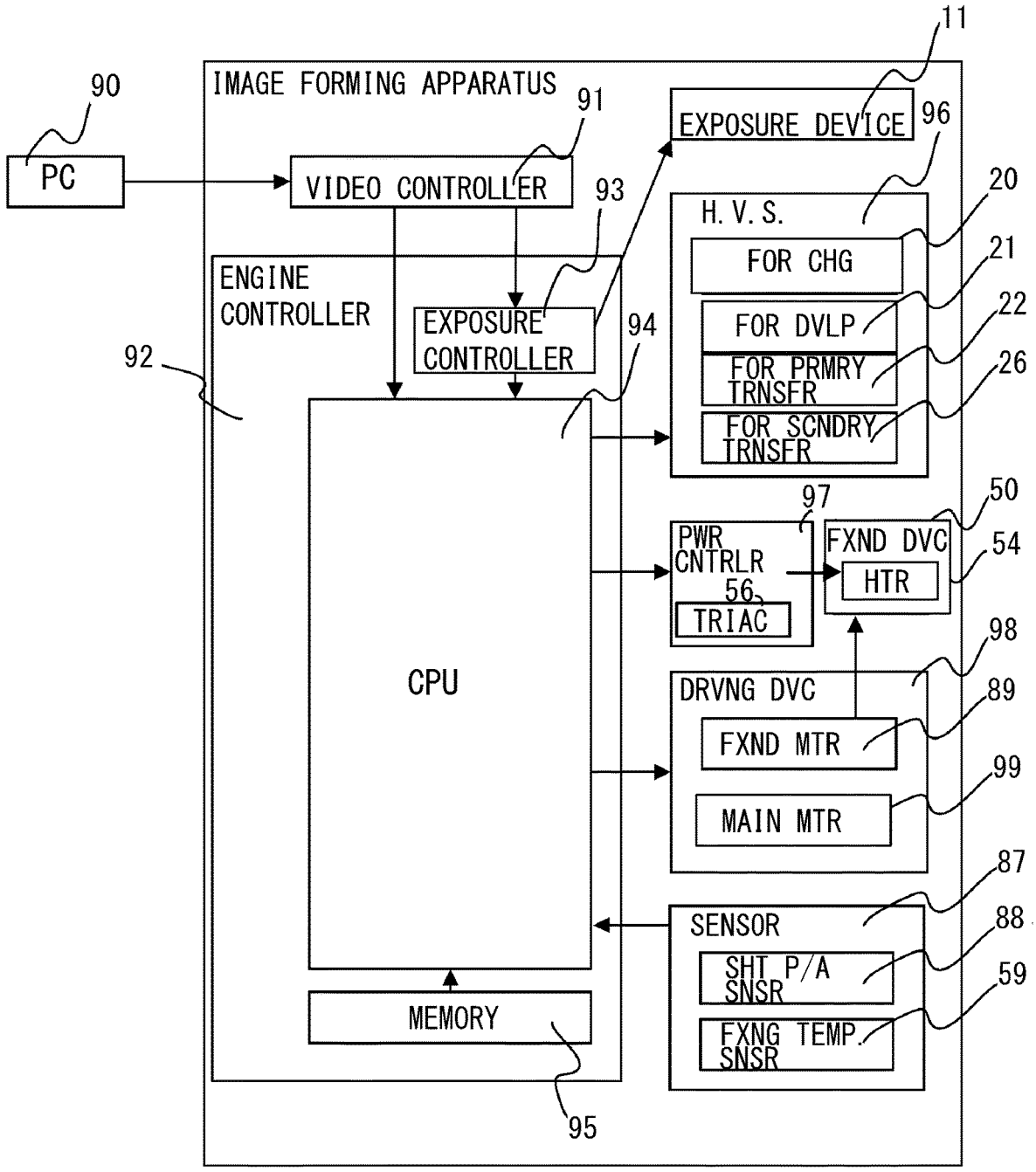
FIG. 2 is a control block diagram of the image forming apparatus of the embodiments 1-3.

Next, an image forming operation of the image forming apparatus of the embodiment 1 will be described. When the image forming apparatus receives a print instruction in a stand-by state, the image forming apparatus starts the image forming operation. The photosensitive drum 1 and the intermediary transfer belt 13, and the like start rotations in the arrow directions at a predetermined process speed by a main motor 99 (FIG. 2). The photosensitive drum 1*a* is electrically charged uniformly by the charging roller 2*a* to which a voltage is applied from the charging high-voltage source 20*a*, and then is exposed to the scanning beam 12*a* emitted from the exposure device 11*a*, so that an electrostatic latent image in accordance with image information is formed on the photosensitive drum 1*a*. Toner 5*a* in the developing unit 8*a* is negatively charged by the developer applying blade 7*a* and is applied onto the developing roller 4*a*. Then, to the developing roller 4*a*, a predetermined developing voltage is supplied from the developing high-voltage source 21*a*. The photosensitive drum 1*a* is rotated, and when the electrostatic latent image formed on the photosensitive drum 1*a* reaches the developing roller 4*a*, the electrostatic latent image is visualized by deposition of the negatively charged toner on the photosensitive drum 1*a*, so that a toner image of a first color (for example, Y (yellow)) is formed in the photosensitive drum 1*a*. The stations (process cartridges 9*b* to 9*d*) for other colors of M (magenta), C (cyan) and K (black) similarly operate. Depending on distances between the respective primary transfer positions for the colors, the electrostatic latent images are formed on the photosensitive drums 1*a* to 1*d* by light exposure while delaying writing signals from a controller (not shown) at certain timings. To each of the primary transfer rollers 10*a* to 10*d*, a DC high-voltage of a polarity opposite to a charge polarity of the toner is applied. By the above-described steps, the toner images are successively transferred onto the intermediary transfer belt 13 (hereinafter, this transfer is referred to as primary transfer), so that a multiple-toner images are formed on the intermediary transfer belt 13.

Thereafter, in synchronism with the toner image formation, a sheet P which is a recording material stacked on a cassette 16 is fed (picked up) by a sheet feeding roller 17 rotationally driven by a sheet feeding solenoid (not shown). The fed sheet P is fed to a registration roller pair 18 by feeding rollers. The sheet P is fed to a transfer nip, which is a contact portion between the intermediary transfer belt 13 and a secondary transfer roller 25, by the registration roller pair 18 in synchronism with the toner image on the intermediary transfer belt 13. To the secondary transfer roller 25, a voltage of a polarity opposite to the charge polarity of the toner is applied by a secondary transfer high-voltage source 26, so that the multiple toner images of the four colors carried on the intermediary transfer belt 13 are collectively transferred onto the sheet (recording material) P (hereinafter, this transfer is formed to as secondary transfer). Members contributing to the image forming operation until the unfixed toner images are formed on the sheet P (for example, the photosensitive drum 1 and the like) function as an image forming means. On the other hand, after the secondary transfer is ended, the toner remaining on the intermediary transfer belt 13 is removed by a cleaning unit 27. A fixing device 50 which is a fixing means is a device for fixing the toner image, after the secondary transfer thereof is ended, on the sheet P, and is constituted by a film 51, a heater 54, a fixing temperature sensor 59 for detecting a temperature of the heater 54, and a pressing roller 53 which is a roller as a rotatable pressing member. The pressing roller 53 is rotatably held at opposite ends and is rotationally driven by a fixing motor 89 (FIG. 2). Further, by rotation of the pressing roller 53, the film 51 is rotated.

The heater 54 as a heating member is controlled to a desired temperature by a CPU 94 (FIG. 2) on the basis of a detection result of the fixing temperature sensor 59 for detecting the temperature of the heater 54. By the heater 54 controlled to the desired temperature, heat is conducted to the film 51. Thus, the sheet P after the secondary transfer is ended is fed to the fixing device 50, in which the toner image is fixed on the sheet P by heat of the film 51 and pressure of the pressing roller 53, and then the sheet P is discharged as an image-formed product (print, copy) onto a discharge tray 30.

[Back Diagram of Image Forming Apparatus]

FIG. 2 is a block diagram for illustrating an operation of the image forming apparatus, and a printing operation of the image forming apparatus will be described while making reference to this figure. A PC 90 which is a host computer performs a function of outputting a printing instruction to a video controller 91 provided inside the image forming apparatus and of transferring image data of a print image to the video controller 91. The video controller 91 converts the image data, from the PC 90, the exposure data, and transfers the exposure data to an exposure control device 93 provided in an engine controller 92. The exposure control device 93 is controlled by the CPU 94, and controls the exposure device 11 for turning on and off the laser light depending on the exposure data. The CPU 94 which is a control means starts an image forming sequence when receives the printing instruction.

In the engine controller 92, the CPU 94, a memory 95 and the like are mounted, and the engine controller 92 performs an operation programmed in advance. A high-voltage source 96 is constituted by the charging high-voltage source 20, the developing high-voltage source 21, the primary transfer high-voltage source 22, and the secondary transfer high-voltage source 26 which are described above. Further, an electric power controller 97 is constituted by a bidirectional thyristor which is a switching element (hereinafter, this element is referred to as a triac) 56. The triac 56 is a switching element put in a conduction state in which the electric power of an AC voltage source 100 is supplied to the heater 54 or in a non-conduction state in which the supply of the electric power is blocked (interrupted). The electric power controller 97 controls a supply amount of the electric power supplied to the heater 54 in the fixing device 50. Further, a driving device 98 is constituted by a main motor 99, the fixing motor 89 and the like. A driving force is transmitted to the pressing roller 53 of the fixing device 50 by the fixing motor 89, so that the pressing roller 53 is rotationally driven. A sensor 87 is constituted by the fixing temperature sensor 59 for detecting the temperature of the fixing device 50, a sheet (paper) presence or absence sensor 88, provided with a flag, for detecting presence or absence of the sheet P, and the like sensor, and a detection result of the sensor 87 is sent to the CPU 94. The CPU 94 acquires the detection result of the sensor 87 in the image forming apparatus, and controls the exposure device 11, the high-voltage source 96, the electric power controller 97, and the driving device 98. By this, the CPU 94 carries out formation of the electrostatic latent image, transfer of the toner image into which the electrostatic latent image is developed, fixing of the toner image on the sheet P, and the like, and thus carries out control of an image forming step in which the exposure data is printed as the toner image on the sheet P.

[Control Circuit Constitution and Operation of Zero-Cross Circuit Portion and Heater]

Figure 3:
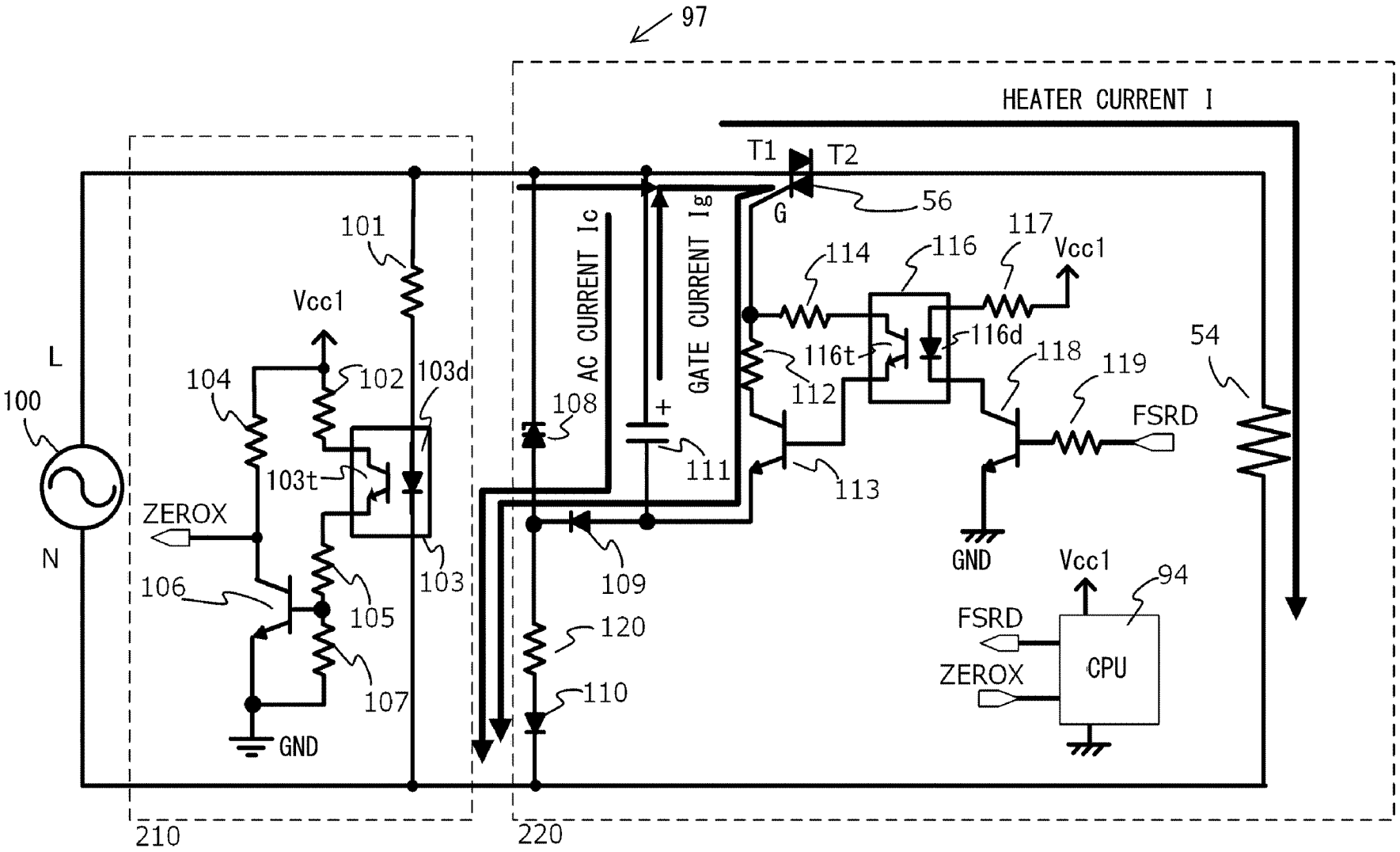
FIG. 3 is a schematic view showing entirety of a circuit constitution of a fixing device of the embodiment 1.

FIG. 3 is a schematic view showing entirety of the electric power controller 97 in the embodiment 1. The electric power controller 97 is constituted by a zero-cross circuit portion 210 and a drive circuit portion 220. The zero-cross circuit portion 210 which is a zero-cross detecting means is connected to the AC voltage source 100, and detects a zero-cross point of the AC voltage source 100. The zero-cross circuit portion 210 includes a photocoupler 103, a transistor 106, resistors 101, 102, 104, 105 and 107. The photocoupler 103 includes a photodiode **103*d* and a light-receiving-side transistor 103*t*. A DC voltage source Vcc1 is a DC value generated by an unshown means, and supplies DC voltages to the zero-cross circuit portion 210, the drive circuit portion 220 and the CPU 94. The drive circuit portion 220 which is a driving means includes a transistor 113, a triac 56 and an electrolytic capacitor 111 which is a voltage source for supplying a gate current Ig to the triac 56. The drive circuit portion 220 further includes Zener diode 108, a photocoupler 116, diodes 109 and 110, and a transistor 118. The photocoupler 116 includes a photodiode 116*d* and a light-receiving-side transistor 116*t*. The drive circuit portion 220 further includes the heater 54 and resistors 112, 114, 117, 119 and 120. Further, the CPU 94 also constitutes the drive circuit portion 220. The triac 56 is connected between the AC voltage source 100 and the heater 54. A positive (+) pole of the capacitor 111 is connected to a T1 terminal of the triac 56. By this, the triac 56 is supplied with the gate current Ig from the capacitor 111. That is, the capacitor 111 functions as a voltage source, other than the AC voltage source, for driving the triac 56**.

(Zero-Cross Circuit Portion)

First, the zero-cross circuit portion 210 will be described. The photocoupler 103 is connected to one pole (Live, hereinafter referred to L-pole) of the AC voltage source 100 via the resistor 101. The electric power is supplied from the L-pole side of the AC voltage source 100, and when the voltage becomes a voltage of a certain value or more, a current flows through the photodiode (hereinafter referred to as LED) **103*d* of the photocoupler 103 via the resistor 101, so that the LED 103*d* emits light. When the LED 103*d* of the photocoupler 103 emits light, a current flows from the DC voltage source Vcc1 connected via the resistor 102 through the light-receiving-side transistor 103*t* of the photocoupler 103. That is, the current flows through the resistor 102, between a collector and an emitter of the light-receiving-side transistor 103*t* of the photocoupler 103, the resistor 105, the resistor 107** and thus flows toward the ground (hereinafter referred to as GND).

Further, at this time, a light receiving current of the photocoupler 103 flows toward a base terminal of the transistor 106. When the light receiving current flows through the base terminal of the transistor 106, the current flows from the DC voltage source Vcc1 toward the resistor 104 and between a collector and an emitter of the transistor 106. A connecting point between the resistor 104 and the transistor 106 is connected as a zero-cross signal ("ZEROX" in FIG. 3) to the CPU 94. As described above, when the light receiving current of the photocoupler 103 flows, the zero-cross signal inputted to the CPU 94 changes from a high level to a low level.

When a potential of the L-pole of the AC voltage source 100 lowers to a certain value or less, the LED 103*d* of the photocoupler 103 turns off, so that the base current of the transistor 106 does not flow. For this reason, the zero-cross signal changes from the low level to the high level. In the case where the electric power is supplied from the other pole (Neutral, hereinafter referred to as N-pole) of the AC voltage source 100, the LED 103*d* of the photocoupler 103 does not emit light. For this reason, the base current of the transistor 106 still does not flow, so that the zero-cross signal does not change while being kept in a high-level state. Thereafter, similarly, the zero-cross circuit portion 210 sends the zero-cross signal to the CPU 94 in synchronism with the operation of the AC voltage source 100.

(Drive Circuit Portion)

Next, the drive circuit portion 220 will be described. On the basis of the zero-cross signal inputted from the zero-cross circuit portion 210 described above, the CPU 94 determines timing when FSRD signal is outputted as described later, and changes the FSRD signal from a low-level state to a high-level state. The FSRD signal is a signal outputted to the drive circuit portion 220 for controlling conduction/non-conduction of the triac 56 by the CPU 94. When the FSRD signal changes from a low level to a high level, the current flows to between a base and an emitter of the transistor 118 via the resistor 119. When the current flows between the base and the emitter of the transistor 118 from the DC voltage source Vcc1 connected via the resistor 117, the current flows through the LED 116*d* of the photocoupler 116 and through between a collector and the emitter of the transistor 118. By this, the LED 116*d* of the photocoupler 116 emits light.

When the LED 116*d* of the photocoupler 116 emits light, in the case where the electric power is supplied from the L-pole side of the AC voltage source 100, the gate current Ig of the triac 56 flows along two paths. A first current path is such that the current flows from the capacitor 111 and the L-pole of the AC voltage source 100 along the following path. That is, the current flows through between a T1 terminal and a gate TL ("G" in FIG. 3) of the triac 56, the resistor 114, between the collector and the emitter of the light-receiving-side transistor 116*t* of the photocoupler 116, between the base and the emitter of the transistor 113, the diode 109, the resistor 120, and the diode 110. Along a second current path, the current flows through between the T1 terminal and the gate terminal of the triac 56, the resistor 112, and the collector and the emitter of the transistor 113 and flows toward the diode 109, the resistor 120 and the diode 110. On the other hand, in the case where the electric power is supplied from the N-pole side of the AC voltage source 100, as regards the gate current Ig of the triac 56, electric charges are supplied only from the capacitor 111, and the current flows along the similar paths.

That is, when the photocoupler 103 emits light, in the case where the electric power is supplied from the L-pole side of the AC voltage source 100, the current flows from both the L-pole side of the AC voltage source 100 and the capacitor 111 to between the T1 terminal and the gate terminal of the triac 56. On the other hand, in the case where the electric power is supplied from the N-pole side of the AC voltage source 100, the current is supplied from only the capacitor 111 to between the T1 terminal and the gate terminal of the triac 56. When the current flows to between the T1 terminal and the gate terminal of the triac 56, the state between the T1 terminal and the gate terminal of the triac 56 changes to a conduction B state (hereinafter referred to as an ON state), so that the current flows between the TL terminal a T2 terminal and thus the electric power is supplied to the heater 54. The current flowing through the heater 54 via the T1 terminal and the T2 terminal is referred to as a heater current I.

When the FSRD signal changes from a high level to a low level, the LED 116*d* of the photocoupler 116 turns off, so that the gate current Ig of the triac 56 does not flow. For this reason, the state between the T1 terminal and the T2 terminal of the triac 56 becomes a non-conduction state (hereinafter referred to as an OFF state), so that the current does not flow between the T1 terminal and the T2 terminal and thus the electric power is not supplied to the heater 54. The CPU 94 switches between the high level and the low level of the FSRD signal and thus controls turning on/off of the gate current Ig, so that the CPU 94 controls supply of the electric power to the heater 54 through the control of the triac 56. Thus, depending on the FSRD signal outputted from the CPU 94, the triac 56 repeats turning-on and turning-off thereof every half-wave of one cyclic period of the AC voltage of the AC voltage source 100 and thus controls the electric power supply to the heater 54.

[Charging and Discharging Operation to Capacitor 111]

(Charging and Discharging Operation)

A charging and discharging operation to the capacitor 111 will be described. When the electric power is supplied from the L-pole side of the AC voltage source 100, electric charges are charged in the capacitor 111 by a charging current Ic flowing along a path via the capacitor 111, the diode 109, the resistor 120 and the diode 110. An upper-limit voltage applied to both terminals the capacitor 110 is restricted by Zener voltage of the Zener diode 108. In the case where the electric power is supplied from the N-pole side of the AC voltage source 100, the direction of the current is restricted depending on the polarity of the diode 110, so that the charging current Ic of capacitor 111 does not flow. That is, the charging operation of the capacitor 111 is performed in a predetermined polarity half-wave (half-wave in which the current flows from the L-pole of the N-pole in the case of the embodiment 1) in one (cyclic) period of the AC voltage.

(Discharging Operation)

Next, the discharging operation will be described. Even in the case where the electric power is supplied from either one of the L-pole side and the N-pole side of the AC voltage source 100, the capacitor 111 discharges the electric charge depending on an operation in which the CPU 94 changes the FSRD signal to the low level or the high level, so that the gate current Ig is caused to flow through between the T1 terminal and the gate terminal of the triac 56. That is, in the case where the triac 56 is turned on when the electric power is supplied from the L-pole side of the AC voltage source 100, the capacitor 111 discharges the electric charge for causing the gate current Ig of the triac 56 to flow while charging the electric charge from the AC voltage source 100. On the other hand, in the case where the triac 56 is turned on when the electric power is supplied from the N-pole side of the AC voltage source 100, in order to cause the gate current Ig of the triac 56 to flow, the capacitor 111 only discharges the electric charge but the electric charge is not charged.

[Operation for Generating Zero-Cross Signal after Correction from Zero-Cross Signal]

Figure 4:
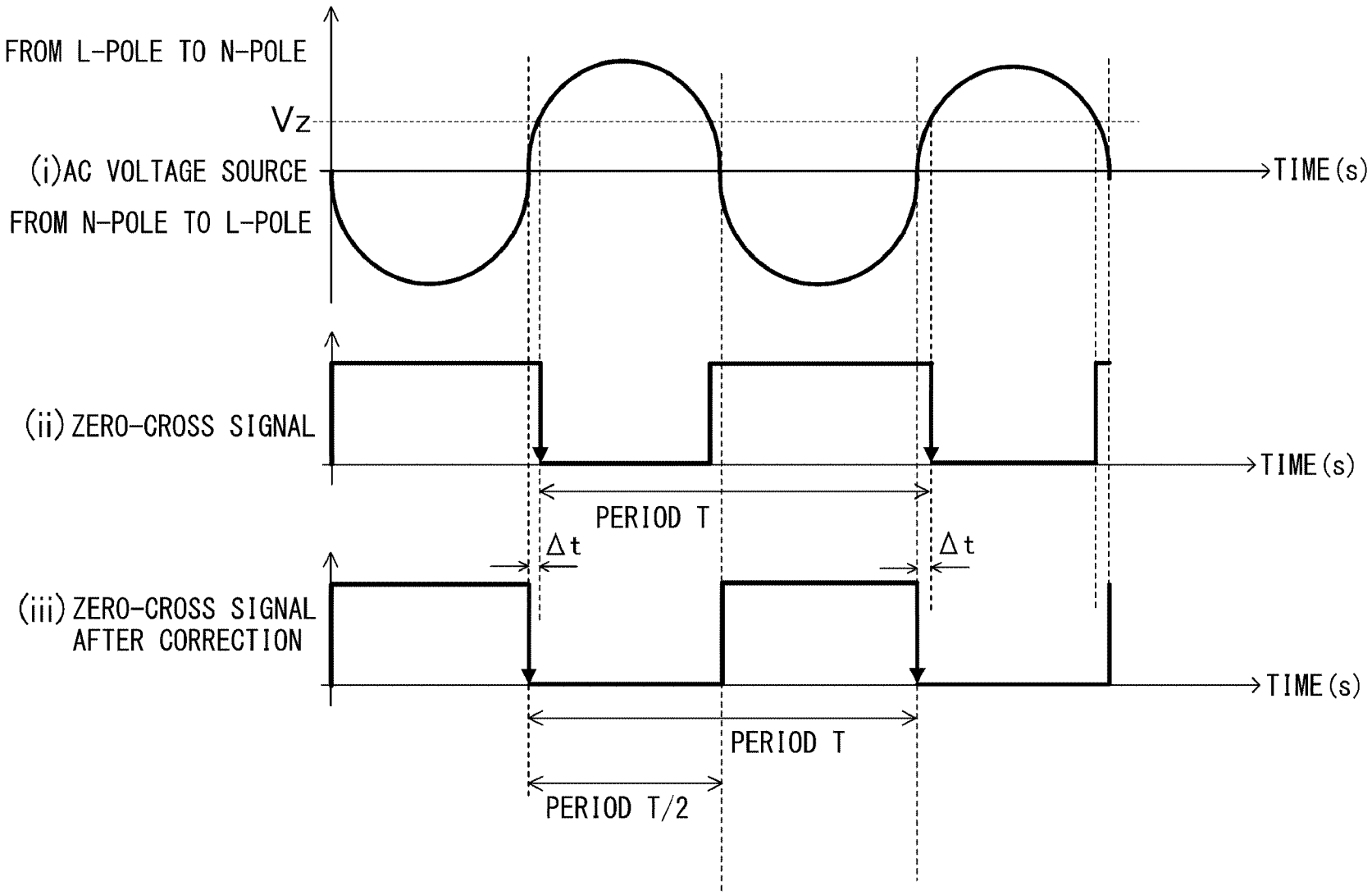
FIG. 4 is a relationship diagram of a zero-cross signal and a zero-cross signal after correction in the embodiment 1.

FIG. 4 includes timing charts showing a relationship between a zero-cross signal inputted to the CPU 94 and a zero-cross signal corrected inside the CPU 94. Part (i) is a graph showing a waveform of the AC voltage of the AC voltage source 100, in which a voltage value during electric power supply from the L-pole to the N-pole is plus (+) and a voltage value during electric power supply from the N-pole to the L-pole is minus (−). Further, the voltage at which the LED 103*d* of the photocoupler 103 emits light is a light emitting voltage Vz and is represented by a broken line. Part (ii) shows a zero-cross signal outputted from the zero-cross circuit portion 210 to the CPU 94. Part (iii) shows a zero-cross signal after the CPU 94 corrects a zero-cross signal on the basis of a zero-cross signal inputted from the zero-cross circuit portion 210 (after correction). In each of parts (i) to (iii), the abscissa represents a time (s (seconds)).

In the case where the electric power is supplied from the N-pole of the AC voltage source 100, as described above, the zero-cross signal is still kept in the high-level state. When the electric power is supplied form the L-pole of the AC voltage source 100, the electric power is supplied from the AC voltage source 100 to the zero-cross circuit portion 210. Further, when a value of the AC voltage of the AC voltage source 100 exceeds the light emitting voltage Vz of the LED 103*d* of the photocoupler 103, the zero-cross circuit portion 210 operates, so that the zero-cross signal changes from the high-level state to the low-level state. When the voltage supplied from the AC voltage source 100 lowers and the LED 103*d* of the photocoupler 103 is turned off, the zero-cross signal changes from the low-level state to the high-level state. The CPU 94 calculates an elapsed time from the last raising timing, as a (cyclic) period T.

After the period T is calculated, on the basis of the inputted zero-cross signal and the calculated period T, a clock signal which repeats high level/low level in the period T is generated. Specifically, the zero-cross signal is such that the signal level changes from the high level to the low level at falling of the zero-cross signal and changes from the low level to the high level at timing of a period T/2 from the falling of the zero-cross signal. Further, the CPU 94 generates a signal in which a phase of the generated clock signal is quickened by Δt determined in advance. In the following, the thus-generated clock signal in the CPU 94 is referred to as a zero-cross signal after correction. By quickening the phase by Δt, the falling of the zero-cross signal is caused to coincide with a zero-cross point of the AC voltage source 100. In the embodiment 1, deviation of the falling of the zero-cross signal from the AC voltage source 100 is, for example, 1.0 ms (millisecond), so that Δt is 1.0 ms. The CPU 94 outputs the FSRD signal on the basis of rising and falling of the zero-cross signal after correction as described above, and carries out ON/OFF control of the triac 56.

[Timing Chart]

Figure 5:
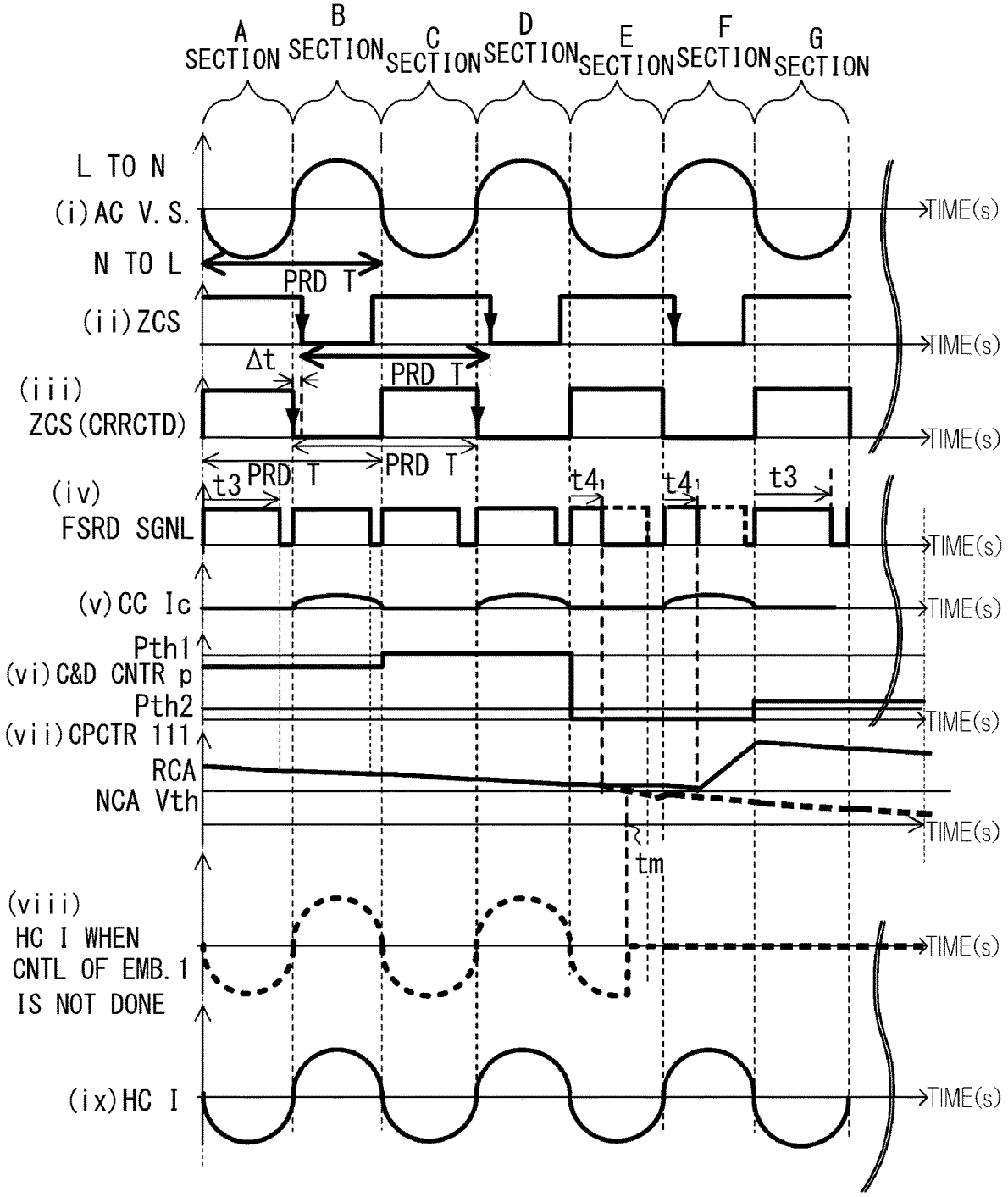
FIG. 5 is a timing chart showing control of a heater in the embodiment 1.

FIG. 5 is a timing chart of respective waveforms and respective signals. Parts (i) to (iii) show waveforms similar to the waveforms of parts (i) to (iii) of FIG. 4, respectively. Part (iv) shows a waveform of the FSRD signal outputted by the CPU 94, and the case where control of the embodiment 1 is not carried out is represented by a broken line. Part (v) shows a waveform of the charging current Ic of the capacitor 111. Part (vi) shows a charge and discharge counter p, and an operation mode switching threshold Pth1 which is a first threshold described later and an operation mode switching threshold Pth2 which is a second threshold described later are represented by thin slid lines. Part (vii) shows a remaining electric charge amount of the capacitor 111, and an electric charge amount of the capacitor 111 necessary to pass the gate current Ig is represented as a necessary electric charge amount Vth by a thin solid line. Further, the remaining electric charge amount in the case where control of the embodiment 1 is not carried out is represented by a broken line. Part (viii) shows a heater current I in the case where the control of the embodiment 1 is not carried out, and the heater current I is represented by a broken line. Part (ix) shows a heater current I in the case where the control of the embodiment 1 is carried out. In each of these parts (i) to (ix), the abscissa represents a time(s). In the embodiment 1, an operation will be described by dividing a section of each of the waveforms into sections A to G for every half-wave of the AC voltage.

The waveform of the AC voltage source 100 is a sine wave which is 50 Hz in frequency and which is 20 ms in period T in the embodiment 1. The sine wave of the AC voltage source 100 is supplied to the electric power controller 97 from the section A to the section G with the period T(s). In the case where the electric power is supplied from the N-pole side of the AC voltage source 100, as shown in the above-described operation, the level of the zero-cross signal is still kept in the high-level state. As shown in FIG. 4, when the electric power is supplied from the L-pole side of the AC voltage source 100 and the voltage becomes the light emitting voltage Vz or more, the state of the zero-cross signal changes from the high-level state to the low-level state (part (ii)). Thereafter, a similar operation is repeated for each period T(s). The zero-cross signal after correction by the CPU 94 is generated on the basis of the zero-cross signal as described above with reference to FIG. 4 (part (iii)).

(Case where Control of Embodiment 1 is not Carried Out)

First, the operation in the case where the control of the embodiment 1 is not carried out will be described. The FSRD signal (part (iv)) and the remaining electric charge amount of the capacitor 111 (part (vii)) are shown by solid lines in the sections A to D and G and by broken lines in the sections E and F. In the case where the control of the embodiment 1 is not carried out, the FSRD signal is continuously outputted in the high-level state for a long time to the extent possible within a half-wave of the same (electric) power control object. When the remaining electric charge amount of the capacitor 111 continuously decreases, at a time instant tm(s) in the section E, the remaining electric charge amount of the capacitor 111 is below the necessary electric charge amount Vth necessary to turn on the triac 56. Thereafter, also in the sections F and G, the FSRD signal continuously decreases every output thereof in the high-level state, and therefore, after the time instance tm(s), the remaining electric charge amount of the capacitor 111 is still below the necessary electric charge amount Vth.

The waveform (operation) of the heater current I in the case where the control of the embodiment 1 is not carried out is shown by the broken line in part (viii) of FIG. 5. In the case where the control of the embodiment 1 is not carried out, in the sections A to D, when the FSRD signal is outputted in the high-level state, the triac 56 is turned on by the above-described operation, so that the heater current I flows through the heater 54. However, in the section embodiment, at timing of the time instance tm(s), the remaining electric charge amount of the capacitor 111 is below the necessary electric charge amount Vth necessary to turn on the triac 56, and therefore, the heater current I does not flow. Also, after the time instant tm(s), the remaining electric charge amount of the capacitor 111 continuously decreases every time when the FSRD signal is outputted in the high-level state, and therefore, the triac 56 cannot be turned on even in the sections F and G, so that the heater current I still does not flow. That is, in the case where the control of the embodiment 1 is not carried out, when the remaining electric charge amount of the capacitor 111 decreases and is below the necessary electric charge amount Vth, from then on, the triac 56 cannot be turned on. Further, ON/OFF control of the triac 56 cannot be carried out substantially continuously.

(Charging and Discharging Counter p)

Next, the charge and discharge counter p (part (vi)) will be described. The charge and discharge counter p is an inner operation (calculation) counter of the CPU 94 provided for predicting (estimating) the remaining electric charge amount of the capacitor 111, and a value of count is renewed every period T, i.e., every full-wave of the AC voltage source 100. The CPU 94 also functions as a predicting means. The charge and discharge counter p operates so that the value of count is incremented every full-wave of the AC voltage source 100 when the FSRD signal is outputted in the high-level state. Further, as described later, the charge and discharge counter p operates so that the value of count is decremented every full-wave in the case where a time in which the FSRD signal is outputted in the high-level state within a half-wave of the same power control object is decreased. Further, the value of count of the charge and discharge counter p is also decremented in the case where the (one) full-wave of the AC voltage source 100 is supplied to the drive circuit portion 220 in a state in which the FSRD signal is not outputted in the low-level state.

The operation mode switching threshold Pth1 and the operation mode switching threshold Pth2 shown in part (vi) are through set for the charge and discharge counter p. In the case where the value of the charge and discharge counter p is the operation mode switching threshold Pth1 (first threshold, predetermined value) or more, as described later, the time in which the FSRD signal within the half-wave of the same power control object is outputted in the high-level state is decreased. Further, in the case where the value of the charge and discharge counter p is the operation mode switching threshold Pth2 or less, as described later, the time in which the FSRD signal is outputted in the high-level state within the half-wave of the same power control object is returned on an original time. The operation mode switching threshold Pth1 is a value determined in advance and is set at a value such that the remaining electric charge amount of the capacitor 111 necessary to cause the gate current Ig of the triac 56 is at least maintained. In the embodiment 1, the operation mode switching threshold Pth1 is +30. In the case where the value of the charge and discharge counter p becomes the operation mode switching threshold Pth1 or more, the CPU 94 predicts that there is a liability that the remaining electric charge amount of the capacitor 111 is below the necessary electric charge amount Vth. Further, the operation mode switching threshold Pth2 is a value determined in advance, and is set at a value such that the value is a sufficient remaining electric charge amount of the capacitor 111 capable of continuously turning on the triac 56 plural times. In the case where the value of the charge and discharge counter p becomes the operation mode switching threshold Pth2 (second threshold) or less, the CPU 94 predicts that the capacitor 111 is sufficiently charged. In the embodiment 1, the operation mode switching threshold Pth2 is +2.

In the embodiment 1, the CPU 94 predicts the remaining electric charge amount of the capacitor 111 on the basis of the value of the charge and discharge counter p. The CPU 94 decreases the time in which the FSRD signal within the half-wave of the same power control object is outputted in the high-level state as described later when the remaining electric charge amount of the capacitor 111 is likely to be below the necessary electric charge amount Vth for the gate current Ig of the triac 56. When on the basis of the value of the charge and discharge counter p in a state in which the time of the high-level state is decreased and the FSRD signal is controlled, the CPU 94 predicts that there is a sufficient remaining electric charge amount of the capacitor 111, the CPU 94 returns, to an original time, the time in which the FSRD signal within the half-wave of the same power control object is outputted in the high-level state.

[Operation of Charge and Discharge Counter]

The operation of the charge and discharge counter p in the embodiment 1 will be described. In the case where the FSRD signal is outputted in the high-level state for a predetermined time and for t3 second (<½T) which is a first time, the charge and discharge counter p is incremented by (+) 2. A state in which the FSRD signal is outputted for t3 second so as to be at the high level is referred to as a first mode. In the case where the FSRD signal is outputted in the high-level state for t4 second which is a second time, the charge and discharge counter p is incremented by −30 (i.e., decremented by 30). A state in which the FSRD signal is outputted for t4 second so as to be at the high level is referred to as a second mode. Here, t3<t4 holds. Further, depending on an unshown previous state, the value of the charge and discharge counter p is +27 (p=+27) in an initial state.

The value of the charge and discharge counter p is renewed every (one) full-wave as described above. In the full-wave (period) consisting of the sections A and B, the high level FSRD signal is outputted for t3 second, and therefore, the CPU 94 increments the charge and discharge counter p by (+) 2 (p=27+2=29). Further, in the full-wave consisting of the sections C and D, the high level FSRD signal is outputted for t3 second, and therefore, the CPU 94 increments the charge and discharge counter p by (+) 2 (p=29+2=31). Through the sections A to D, the value of the charge and discharge counter p increases up to +31. Thus, in the section C, the value of the charge and discharge counter p exceeds the operation mode switching threshold Pth1 (=30), (i.e., p>Pth1). The CPU 94 predicts that the remaining electric charge amount of the capacitor 111 is below the necessary electric charge amount Vth. For this reason, in the section E, the CPU 94 changes the time, in which the FSRD signal is outputted in the high-level state, from t3 second to t4 second and outputs the FSRD signal. In other words, the CPU 94 changes an operation mode from the first mode to the second mode. In the section E, the CPU 94 outputs the FSRD signal for T3 second. At this time, the value of the charge and discharge counter p is incremented from +31 by −30 to result in (+) 1 (p=31-30=1) by the above-described operation. By this, the value of the charge and discharge counter p is below +2 which is the operation mode switching threshold Pth2 (p<Pth2). The CPU 94 predicts that the remaining electric charge amount of the capacitor 111 is sufficient. In the section G, the CPU 94 outputs the FSRD signal again in the high-level state for t3 second. In other words, the CPU 94 changes the operation mode from the second mode to the first mode. In (one) full-wave (period) consisting of the section G and a subsequent section, the FSRD signal is outputted in the high-level state for t2 second, and therefore, the CPU 94 increments the charge and discharge counter p by (+) 2 (p=1+2=3). By this, the value of the charge and discharge counter p becomes +3. Thereafter, a similar operation is repetitively performed.

[Operation of FSRD Signal]

Next, an outline of the operation of the FSRD signal in the embodiment 1 will be described. In the embodiment 1, the FSRD signal is outputted in states of two kinds consisting of the case where a time in which the FSRD signal is outputted in the high-level state within the half-wave of the same power control object is long and the case where the time is short. In one state, the FSRD signal is outputted in the high-level state for a long time to the extent possible within the half-wave of the same power control object. In the other state, the FSRD signal is outputted in the high-level state for a short time within the half-wave of the same power control object. In the embodiment 1, in the case where the FSRD signal is outputted in the high-level state for the long time to the extent possible within the half-wave of the same power control object, the FSRD signal is outputted in the high-level state for the t3 (s) from the rising or the falling of the zero-cross signal after the correction by the CPU 94. In the case where the time in which the FSRD signal is outputted in the high-level state is short within the half-wave of the same power control object, the FSRD signal is outputted in the high-level state for the t4 (s) from the rising or the falling of the zero-cross signal after the correction by the CPU 94.

The t3 is a time determined in advance, and is a value such that the time is a long time to the extent possible within the half-wave of the same power control object so as not to erroneously turn on the triac 56 in a half-wave subsequent to the half-wave of the same power control object, due to noise or the like. For example, the t3 is a time close to ½ T (=10 ms). In the embodiment 1, the t3 is 8.5 ms, for example. Further, the t4 is a time determined in advance, and is a value such that the electric charge of the capacitor 111 is charged to a maximum value within fall-wave (period) of the AC voltage source 100. In the embodiment 1, the t4 is 2.0 ms, for example. In the embodiment 1, the FSRD signal is ordinarily outputted in the high-level state for t2 second on the basis of the zero-cross signal after the correction by the CPU 94, within the half-wave of the same power control object. Then, when the value of the charge and discharge counter p becomes the operation mode switching threshold Pth1 or more as described above, the CPU 94 changes the time, in which the FSRD signal is outputted in the high-level state within the half-wave of the same power control object, from the t3 to the t4. Thereafter, when the value of the charge and discharge counter p becomes the operation mode switching threshold Pth2 or less, the time in which the FSRD signal is outputted in the high-level state within the half-wave of the same power control object is changed from the t4 to the t3.

A specific operation of the FSRD signal in the embodiment 1 will be described. In the sections A, C and G, the FSRD signal is outputted by the CPU 94 in the high-level state for the t3 second at timing of the rising of the zero-cross signal after the correction by the CPU 94, and thereafter, the level of the FSRD signal changes to the low level. Further, in the periods B and D, the FSRD signal is outputted by the CPU 94 in the high-level state for the t3 second at timing of the falling of the zero-cross signal after the correction by the CPU 94, and thereafter, the level of the FSRD changes to the low level.

In the sections E and F, the value of the above-described charge and discharge counter p becomes the operation mode switching threshold Pth1 or more. For this reason, within the half-wave of the same power control object, the time in which the FSRD signal is outputted in the high-level state is decreased to the t4 and the control is carried out. In the section E, the FSRD signal is outputted in the high-level state for the t4 second from timing of the rising of the zero-cross signal after the correction by the CPU 94, and thereafter, the level thereof changes to the low level. In the section F, the FSRD signal is outputted in the high-level state for the t4 second from timing of the falling of the zero-cross signal after the correction by the CPU 94, and thereafter, the level thereof changes to the low level.

[Operation of Charging Current Ic]

Next, an operation of the charging current Ic of the capacitor 111 will be described. As described above, the charging current Ic is a current flowing so that the electric charge is charged in the capacitor 111 when the electric power is supplied from the L-pole side of the AC voltage source 100, i.e., in the sections B, D and F. When the electric power is supplied from the L-pole side of the AC voltage source 100, the charging current Ic flows through the capacitor 111 every half-wave along the above-described path.

[Electric Charge Amount of Capacitor 111]

Next, a fluctuation in electric charge amount of the capacitor 111 will be described. In an initial state of a timing chart, the capacitor 111 is charged to a certain degree. When the FSRD signal is outputted in the high-level state, the current flows from the capacitor 111 to the gate terminal of the triac 56, so that the electric charge decreases. First, as in the sections A, C, E and G, in the case where the electric power is supplied from the N-pole side of the AC voltage source 100, the electric charge is not charged in the capacitor 111. When the electric power is supplied from the N-pole side of the AC voltage source 100, in the case where the FSRD signal is outputted from the CPU 94 and the gate current Ig of the triac 56 flows from the capacitor 111, the electric charge of the capacitor 111 most decreases. When the electric power is supplied from the N-pole side of the AC voltage source 100, during output of the FSRD signal from the CPU 94, the electric charge of the capacitor 111 continuously decreases. When the FSRD signal is not outputted, the electric charge of the capacitor 111 becomes constant.

Next, as in the sections B, D and F, when the electric power is supplied from the L-pole side of the AC voltage source 100, in the case where the FSRD signal is outputted from the CPU 94 and the gate current Ig of the triac 56 flows from the capacitor 111, the electric charge decreases. Simultaneously, the charging current IC flows from the L-pole side of the AC voltage source 100, so that the electric charge is charged to the capacitor 111. That is, when the electric power is supplied from the L-pole side from the AC voltage source 100, during output of the FSRD signal from the CPU 94, the charging current Ic flows from the L-pole side of the AC voltage source 100 while the capacitor 111 is discharged, so that the capacitor 111 is charged. For this reason, the electric charge of the capacitor 111 continuously decreases moderately compared with the sections A, C, E and G. When the electric power is supplied from the L-pole side of the AC voltage source 100, in the case where the FSRD side is not outputted, the electric charge of the capacitor 111 is charged and increases.

In the sections E and F in the embodiment 1, the remaining electric charge amount of the capacitor 111 in the case where the control of the embodiment 1 is carried out is shown by a solid line. In the case where the control of the embodiment 1 is carried out, in the sections E and F, as described above, the value of the charge and discharge counter p exceeds the value of the operation mode switching threshold Pth1 and the time in which the FSRD signal is outputted in the high-level state decreases from the t3(s) to the t4(s). The CPU 94 outputs the FSRD signal in the high-level state for the t4(s), and then changes the level of the FSRD signal to the low level. After the level of the FSRD signal is changed to the low level, in the section F, the electric charge of the capacitor 111 is charged by the charging current Ic of the capacitor 111, so that the electric charge of the capacitor 111 increases. Thereafter, the operation as described above is repeated.

[Operation of Heater Current I]

Finally, an operation of the heater current I flowing through the heater 54 will be described. A solid line of part (ix) shows the operation of the heater current I flowing through the heater 54 in the case where the control of the embodiment 1 is carried out. The heater current I starts to flow at timing when the FSRD signal is outputted in the high-level state when the electric power is supplied from the AC voltage source 100, as described above with reference to FIG. 4, and continuously flows to a subsequent zero-cross point of the AC voltage source. In the case where the control of the embodiment 1 is carried out as described above, the remaining electric charge amount is not below the necessary electric charge amount Vth which is a remaining electric charge amount necessary that the remaining electric charge amount of the capacitor 111 causes the gate current Ig of the triac 56 to flow. For this reason, in all the half-wave sections from the section A to the section G, the heater current I continuously flows from the timing when the FSRD signal is outputted in the high-level state to a subsequent zero-cross point of the AC voltage source 100.

As described above, in the case where the control of the embodiment 1 is carried out, in the section E, the CPU 94 outputs the FSRD signal in the high-level state for the t4(s) and changes the level of the FSRD signal to the low level. Thereafter, the discharge amount within the half-wave of the same power control object decreases, so that the electric charge of the triac 56 is maintained or charged and thus increases. Then, the electric charge amount of the capacitor 111 can be maintained without being below the necessary electric charge amount Vth for the gate current Ig necessary to turn on the triac 56. For this reason, also in the sections F and G, it is possible to continuously supply the gate current Ig, from the capacitor 111, necessary to turn on the triac 56. For this reason, the triac 56 is substantially continuously subjected to ON/OFF control, so that the heater current I can be continuously passed through the heater 54.

[Flowchart]

Figure 6:
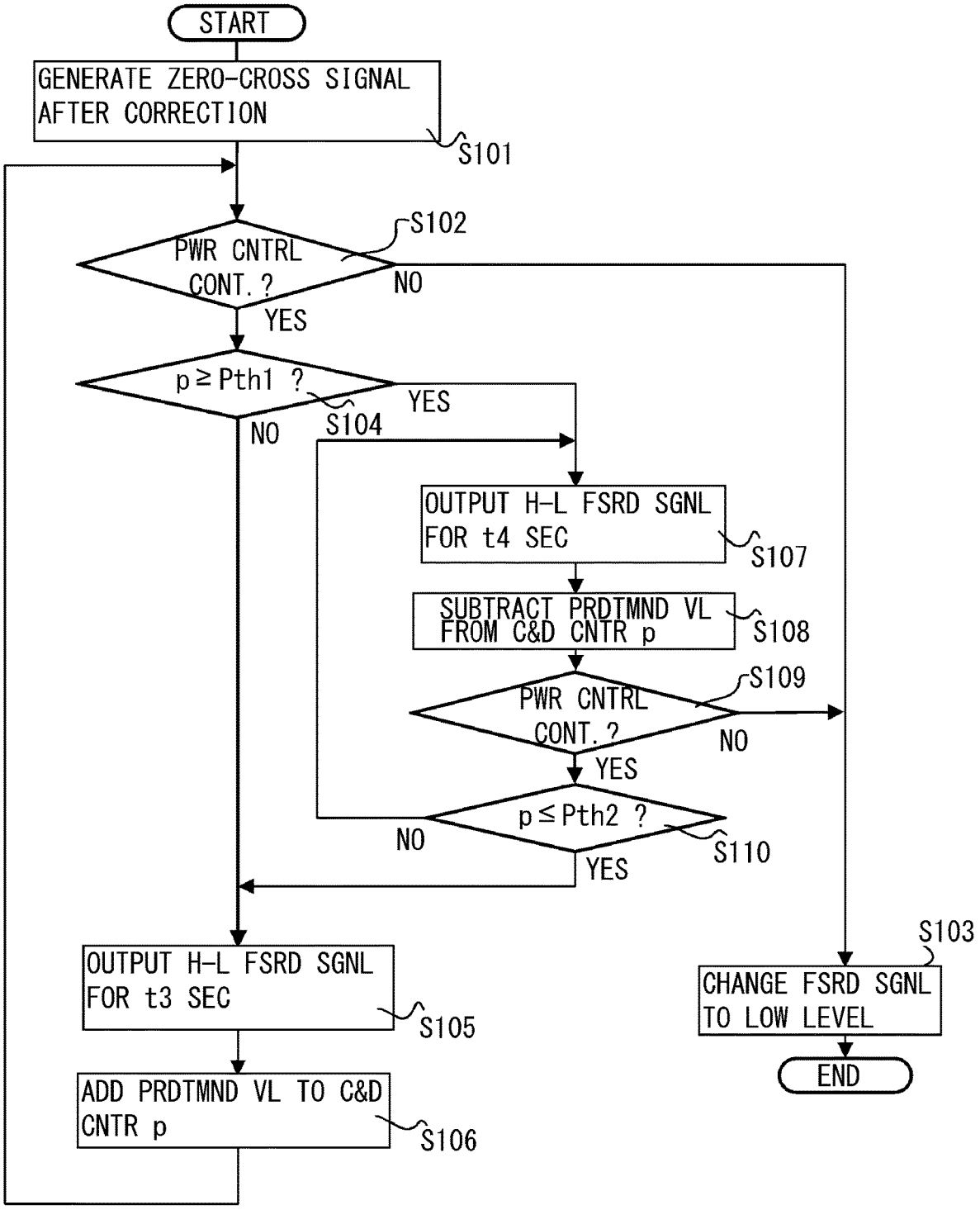
FIG. 6 is a flowchart showing the control of the heater in the embodiment 1.

FIG. 6 is a flow chart showing an electric power control process of the heater 54 by the CPU 94. In a step (hereinafter referred to as S) 101, the CPU 94 corrects therein, as described above, the zero-cross signal outputted from the zero-cross circuit portion 210, and generates the zero-cross signal after correction. In S102, the CPU 94 discriminates on the basis of a value detected by the fixing temperature sensor 59, whether or not the electric power control to the heater 54 is continued in a full-wave (period) of a subsequent AC voltage at a target temperature (temperature control target value) of the heater 54. In the case where the CPU 94 discriminated in S102 that the electric power control to the heater 54 is not continued, the process goes to S103, and in the case where the CPU 94 discriminated in S102 that the electric power control to the heater 54 is continued, the process goes to S104. In S103, the CPU 94 changes the output of the FSRD signal to the low level, and stops the control and ends the step.

In S104, the CPU 94 makes reference to the charge and discharge counter p and discriminates whether or not the value of the charge and discharge counter p is the operation mode switching threshold Pth1 or more. In the case where the CPU 94 discriminated in S104 that the value of the charge and discharge counter p is the operation mode switching threshold Vthl or more (p Pth1), the process goes to S107. On the other hand, in the case where the CPU 94 discriminated that the value of the charge and discharge counter p is less than the operation mode switching threshold Pth1 (first threshold, predetermined value) (p<Pth1), the process goes to S105. In S105, the CPU 94 changes the state of the FSRD signal to the high-level state for the t3(s) on the basis of the rising or the falling of the zero-cross signal which is generated in S101 and after the correction, and then outputs the FSRD signal. By this, the CPU 94 puts the triac 56 in an ON state and causes the heater current I to flow through the heater 54, so that the electric power is supplied to the heater 54. In S106, the CPU 94 increments the value of the charge and discharge counter p by a predetermined value determined in advance since the state of the FSRD signal is changed in the high-level state for the t3(s) and is outputted, and the process is returned to S102. For example, the CPU 94 adds 2 to the value of the charge and discharge counter p (p=p+2).

In S107, the CPU 94 changes the state of the FSRD signal to the high-level state for the t4(s) within the half-wave of the same power control object as described above, on the basis of the rising or the falling of the zero-cross signal which is generated in S101 and after the correction, and then outputs the FSRD signal. By this, the CPU 94 puts the triac 56 in an ON state and causes the heater current I to flow through the heater 54, so that the electric power is supplied to the heater 54. In S108, the CPU 94 decrements the value of the charge and discharge counter p by a predetermined value determined in advance since the state of the FSRD signal is changed in the high-level state for the t4(s) and is outputted. For example, the CPU 94 subtracts 30 from the value of the charge and discharge counter p (p=p−30).

In S107, the CPU 94 discriminates whether or not the electric power control to the heater 54 in a subsequent full-wave (period) of the AC voltage. In the case where the CPU 94 discriminated in S109 that the electric power control to the heater 54 is not continued, the process goes to S103, and in the case where the CPU 94 discriminates in S109 that the electric power control to the heater 54 is continued, the process goes to S110. The CPU 94 discriminates in S110 whether or not the value of the charge and discharge counter p is the operation mode switching threshold Pth2 or less by making reference to the charge and discharge counter p. In the case where the CPU 94 discriminated in S110 that the value of the charge and discharge counter p is the operation mode switching threshold Pth2 or less, the process goes to S105, and in the case where the value of the charge and discharge counter p is larger than the operation mode switching threshold Pth2, the process is returned to S107. Thereafter, similar control is repeated.

By carrying out the control described above, in the case where sufficient electric charge is accumulated in the capacitor 111, the FSRD signal is outputted in the high-level state for a long time to the extent possible (for example, t3) within the half-wave of the same power control object. On the other hand, in the case where the electric charge accumulated in the capacitor 111 is insufficient, the FSRD signal is outputted for a short time (for example t4 (<t3) within the half-wave of the same power control object, so that the remaining electric charge of the capacitor 111 can be maintained or charged. As described above, the gate current Ig of the triac 56 is continuously passed for a long time to the extent possible within the half-wave of the same power control object, so that turning-off of the triac 56 due to noise and distortion of the AC voltage source 100 is prevented. In the case where a cumulative time (corresponding to the value of the charge and discharge counter p) in which the FSRD signal is outputted at the high level for a long time to the extent possible within the half-wave (period) of the same power control object is a predetermined time (corresponding to the operation mode switching threshold Pth1) or more, the CPU 94 predicts that the electric charge of the capacitor 111 decreases. Then, the time in which the FSRD signal is outputted in the high-level state within the half-wave of the same power control object is decreased, so that the electric charge amount of the capacitor 111 which is a voltage source is maintained or charged. By doing so, without adding a circuit component part causing an increase in cost the triac 56 can be substantially continuously subjected to electric power control by a simple means while avoiding the influence due to the distortion and the noise of the AC voltage source.

As described above, according to the embodiment 1, in the circuit in which the switching element is controlled by the voltage source other than the AC voltage source, while suppressing the increase in cost, the influence due to the distortion and the noise of the AC voltage is avoided by the simple means, so that it is possible to continuously control the switching element.

Embodiment 2

In the embodiment 1, the constitution in which the gate current Ig of the triac 56 is continuously passed for the long time to the extent possible within the half-wave of the same power control object in order to avoid the turning-off of the triac 56 by the influence of the noise superposed on the AC voltage source 100 was employed. In such a constitution, in the case where the electric charge of the capacitor 111 is decreased through cumulative flow of the gate current Ig predetermined times or more, the time of the flow of the gate current Ig is decreased from the t2 second to the t4 (<t3) second, so that control is carried out so as to maintain the electric charge amount of the capacitor 111. In the embodiment 2, a constitution in which in order to avoid the turning-off of the triac 56 by the influence of the noise superposed on the AC voltage source 100, the gate current Ig of the triac 56 is passed by dividing an operation into a plurality of times within the half-wave of the same power control object is employed. In such a constitution, in the case where the electric charge of the capacitor 111 is decreased by cumulatively passing the gate current Ig a predetermined number of times, a constitution in which the number of times that the gate current Ig is passed within the half-wave of the same power control object is decreased and thus the electric charge of the capacitor 111 is maintained is employed. Further, a constitution in which in the case where the electric power supply to the heater 54 is controlled by using a predetermined number of half-waves of the AC voltage as one control unit, a decrease of the electric charge in the one control unit is predicted will be described. Incidentally, in the embodiment 1, the one control unit can be said as two half-wave (period) or one full-wave (period). A circuit constitution is similar to the circuit constitution in the embodiment 1, and will be omitted from description in the embodiment 1.

[Relationship Between Electric Power Control Table and Charge and Discharge Counter]

A table 1(a) is a table such that a level of the electric power supplied to the heater 54 is divided into 17 levels from an electric power supply level 0 to an electric power supply level 16 and that a predetermined number of half-waves of the AC voltage, for example, the case where the electric power is controlled on a wave number unit including 16 half-waves, i.e., 16 half-waves are used as one control unit. Here, an electric power supply level is an amount of electric power supplied to the heater 54 in the one control unit, and is determined on the basis of a target temperature of the heater 54 and a detection result of the fixing temperature sensor 59, for example.

TABLE 1(a)

| POWER SUPPLY LEVEL | SUPPLY RATIO (%) | CHARGING AND DISCHARGING COUNTER p INCREMENT: FSRD SIGNAL BEFORE CHANGE | CHARGING AND DISCHARGING COUNTER p INCREMENT: FSRD SIGNAL AFTER CHANGE | HALF-WAVE CONTROL PERIOD (n HALF-WAVES) 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|---|
| 16 | 100.00 | +3 | −40 | 1 | −1 | 1 | −1 | 1 | −1 | 1 | −1 | 1 | −1 | 1 | −1 | 1 | −1 | 1 | −1 |
| 15 | 93.75 | | | 1 | −1 | 1 | −1 | 1 | −1 | 1 | −1 | 0 | −1 | 1 | −1 | 1 | −1 | 1 | −1 |
| 14 | 87.50 | | | 1 | −1 | 1 | 0 | 1 | −1 | 1 | −1 | 1 | −1 | 1 | −1 | 0 | −1 | 1 | −1 |
| 13 | 81.25 | | | 1 | 0 | 1 | −1 | 1 | −1 | 1 | 0 | 1 | −1 | 1 | −1 | 0 | −1 | 1 | −1 |
| 12 | 75.00 | | | 1 | −1 | 0 | −1 | 1 | −1 | 0 | −1 | 1 | 0 | 1 | −1 | 1 | 0 | 1 | −1 |
| 11 | 68.75 | | | 1 | −1 | 0 | −1 | 1 | 0 | 1 | −1 | 0 | −1 | 1 | 0 | 1 | −1 | 0 | −1 |
| 10 | 62.50 | | | 1 | 0 | 1 | 0 | 1 | −1 | 0 | −1 | 1 | 0 | 1 | −1 | 0 | −1 | 0 | −1 |
| 9 | 56.25 | +2 | −45 | 1 | 0 | 1 | 0 | 1 | −1 | 0 | 0 | 1 | −1 | 0 | −1 | 0 | −1 | 0 | −1 |
| 8 | 50.00 | | | 1 | 0 | 1 | 0 | 0 | −1 | 1 | 0 | 0 | −1 | 0 | 0 | 1 | −1 | 0 | −1 |
| 7 | 43.75 | | | 0 | −1 | 0 | −1 | 0 | 0 | 1 | 0 | 0 | −1 | 0 | −1 | 1 | 0 | 1 | 0 |
| 6 | 37.50 | | | 0 | −1 | 0 | −1 | 0 | 0 | 1 | 0 | 0 | −1 | 0 | 0 | 1 | 0 | 1 | 0 |
| 5 | 31.25 | | | 0 | −1 | 0 | 0 | 1 | 0 | 0 | −1 | 0 | 0 | 0 | −1 | 0 | 0 | 1 | 0 |
| 4 | 25.00 | +1 | −50 | 0 | −1 | 0 | 0 | 0 | −1 | 0 | 0 | 0 | 0 | 1 | 0 | 0 | 0 | 1 | 0 |
| 3 | 18.75 | | | 0 | 0 | 1 | 0 | 0 | 0 | 0 | −1 | 0 | 0 | 0 | 0 | 0 | −1 | 0 | 0 |
| 2 | 12.50 | | | 0 | 0 | 0 | −1 | 0 | 0 | 0 | 0 | 0 | 0 | 0 | 0 | 0 | 1 | 0 | 0 |
| 1 | 6.25 | | | 0 | 0 | 0 | 0 | 0 | 0 | 0 | −1 | 0 | 0 | 0 | 0 | 0 | 0 | 0 | 0 |
| 0 | 0.00 | −50 | | 0 | 0 | 0 | 0 | 0 | 0 | 0 | 0 | 0 | 0 | 0 | 0 | 0 | 0 | 0 | 0 |

A table 1(a) shows electric power supply levels (0 to 16) in a first column, and shows an electric power supply ratio (%) in a second column. The table 1(a) further shows an increment of the charge and discharge counter p before change which is a first value of the FSRD signal and a negative increment (i.e., decrement) of the charge and discharge counter p after change which is a second value of the FSRD signal, in a third column, and shows a half-wave control period (n half-waves) in a fourth column. The half-wave control period represents a half-wave (period) in the one control unit, and in the embodiment 2, the one control unit includes 16 half-waves, and therefore, with respect to each of a first half-wave to a 16-th half-wave, either one of values of 1, 0 and −1 is shown.

Figure 12:
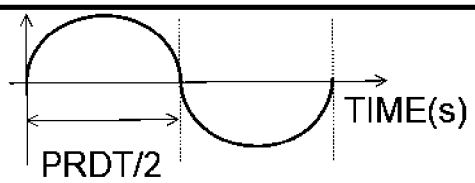
FIG. 12 shows waveforms supplied to a heater in correspondence to values of 1, 0 and −1 listed in Table 1(a).
Figure 12:
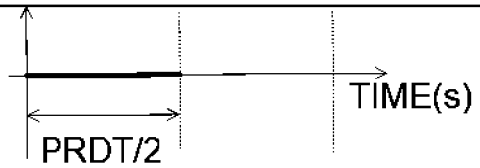
Figure 12:
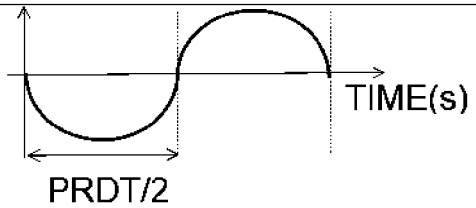

As described above, the CPU 94 controls turning and turning-off of the triac 56, and controls the electric power supplied to the heater 54 on a half-wave unit. Numerals such as 1, 0 and −1 shown in the fourth column of the table 1(a) correspond to current values supplied to the heater 54 as shown in FIG. 12. For example, in the case where the numeral indicated for a predetermined half-wave in the fourth column of the table 1(a) is "1", it means that a current with a waveform such that a first half-wave of a full-wave is a positive waveform and a subsequent (second) half-wave of the full-wave is a negative waveform as shown in FIG. 12. The table 1(a) shows, for example, that in the case of the electric power supply level 16, the electric power supply ratio is 100% and the triac 56 is continuously turned on over the 16 half-waves, and thus that the current is continuously supplied to the heater 54 over the 16 half-waves. Incidentally, as regards the charge and discharge counter p, only the increment (value) and the decrement (value) are different from those in the embodiment 1, but other constitutions are similar to those in the embodiment 1.

In the case where an ordinary FSRD signal is outputted at the electric power supply levels from 10 to 16 in the table 1(a), the CPU 94 increments the value of the charge and discharge counter p by +3. On the other hand, in the case where an output method of the FSRD signal described later is changed, the CPU 94 increments the value of the charge and discharge counter p by −40 (i.e., decrements the value of the charge and discharge counter p by 40). In the case where the original FSRD signal is outputted at the electric power supply levels from 5 to 9 in the table 1(a), the CPU 94 increments the value of the charge and discharge counter p by +3. On the other hand, in the case where an output method of the FSRD signal described later is changed, the CPU 94 increments the value of the charge and discharge counter p by −45 (i.e., decrements the value of the charge and discharge counter p by 45). In the case where the original FSRD signal is outputted at the electric power supply levels from 1 to 4, the CPU 94 increments the value of the charge and discharge counter p by +1. On the other hand, in the case where an output method of the FSRD signal described later is changed, the CPU 94 increments the value of the charge and discharge counter p by −50 (i.e., decrements the value of the charge and discharge counter p by 50). At the electric power supply level 0, the FSRD signal is not outputted, and the capacitor 111 is charged only, and therefore, the CPU 94 increments the value of the charge and discharge counter p by −50 (i.e., decrements the value of the charge and discharge counter p by 50). Thus, in the embodiment 2, the increment (value) and the decrement (value) of the charge and discharge counter p are changed (switched) on the basis of the electric power supply level. The increment of the charge and discharge counter p before the FSRD signal is changed after discrimination that the remaining electric charge amount of the capacitor 111 is not insufficient is made is larger with an increasing electric power supply level. The decrement of the charge and discharge counter p after the FSRD signal is changed after discrimination that the remaining electric charge amount of the capacitor 111 is insufficient is made is smaller with a decreasing electric power supply level.

[Mode a and Mode B in Embodiment 2]

Figure 7:
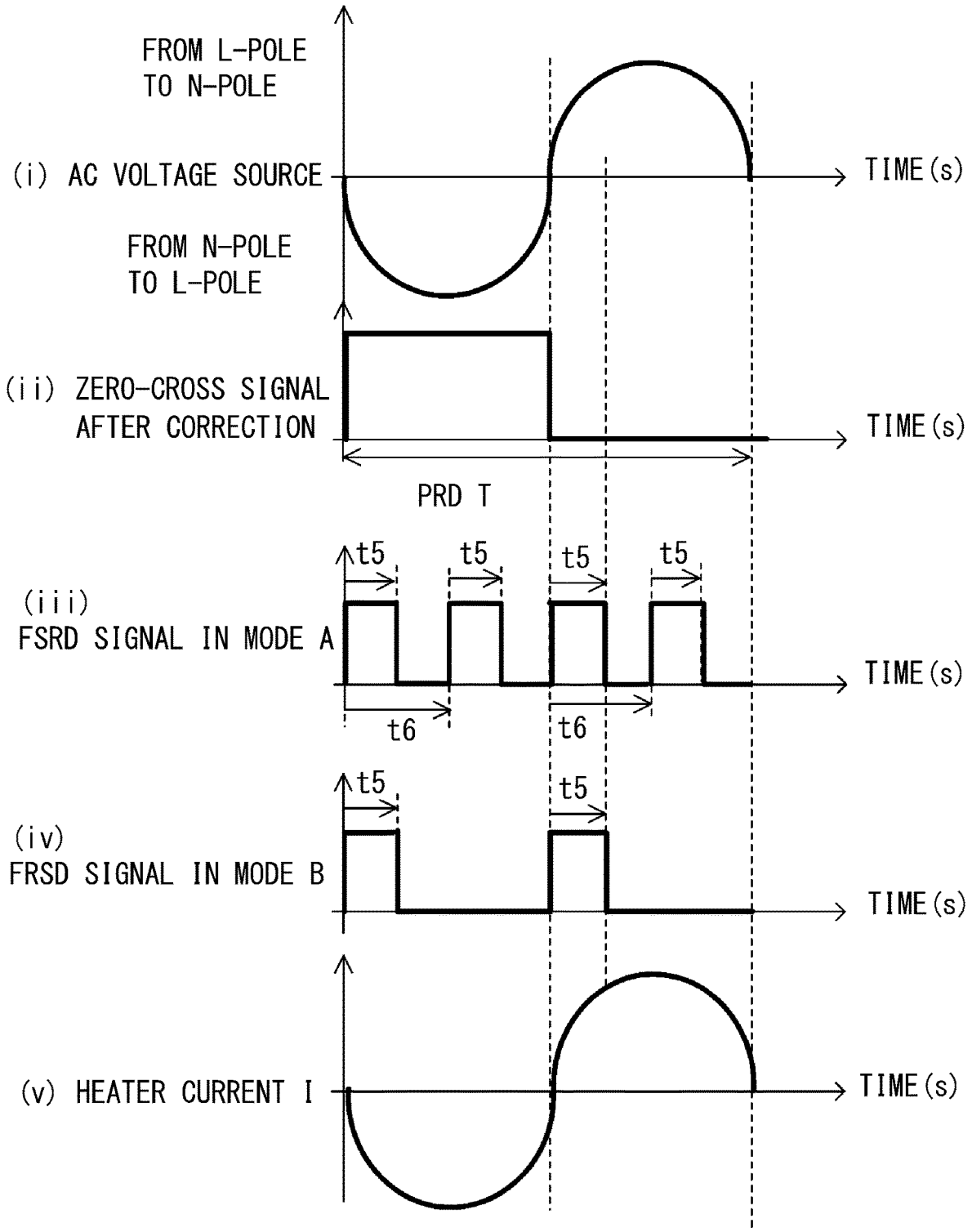
FIG. 7 is a timing chart showing control of a heater in the embodiment 2, in which only one full-wave is enlarged.

FIG. 7 includes timing charts in the embodiment 2. In FIG. 7, part (i) shows a waveform of an AC voltage of the AC voltage source 100, part (ii) shows a waveform of a zero-cross signal after correction, part (iii) shows a waveform of an FSRD signal in an operation in a mode A described later, part (iv) shows a waveform of an FSRD signal in an operation in a mode B described later, and part (v) shows a waveform of a heater current I. In the embodiment 2, operations other than those of the FSRD signal, the charge and discharge counter p, and the remaining electric charge amount of the capacitor 111 are similar to those in the embodiment 1, and therefore, will be omitted from description.

(Operation of FSRD Signal)

First, an outline of an operation of the FSRD signal will be described. In the embodiment 2, there are two kinds of output operations of the FSRD signal within the half-wave of the same power control object. One is an operation in which within the half-wave of the same power control object, the number of times of the output of the FSRD signal in the high-level state is a plurality of times, and hereinafter, this output operation is referred to as the operation in the mode A which is a first mode. The other one is an operation in which within the half-wave of the same power control object, the FSRD signal is outputted only once, and hereinafter, this output operation is referred to as the operation in the mode B which is a second mode. Incidentally, in each of the mode A and the mode B, a time in which a single FSRD signal in the high-level state is outputted is the same time t5 ($<\frac{1}{2}T$).

(Mode A)

First, the operation in the mode A will be described. The FSRD signal outputted plural times in the high-level state is the following signal. On the basis of the falling or the rising of the zero-cross signal after the correction by the CPU 94, a first FSRD signal in the high-level state is outputted for t5 section. Further, after a lapse of t6 second (Here, $t5<t6<\frac{1}{2}T$) from the falling or the rising of the zero-cross signal after the correction, a second FSRD signal in the high-level state is outputted for t5 second. The t5 which is a third time is a value determined in advance, and is set at a time which is not less than a necessary minimum duration of a time required for passing the gate current Ig of the triac 56. In the embodiment 2, the time t5 is 2.0 ms, for example.

The t6 is a time from the falling or the rising of the zero-cross signal after the correction by the CPU 94 to a start of the output of the second FSRD signal in the high-level state within the half-wave of the same power control object. The t6 is a time determined in advance and is set at a time in which a sufficient phase difference can be ensured from timing of the output of the first FSRD signal in the high-level state within the half-wave of the same power control object. In the embodiment 2, the time t6 is 5.0 ms, for example. By making the setting as described above, in the operation in the mode A in the embodiment 2, within one half-wave (period), the FSRD signal with a high-level state time of A5 is outputted plural times, for example twice, so that a cumulative time in which the gate current Ig flows within one half-wave is t5×2. The FSRD D signal outputted plural times each in the high-level state for the t2 second is a signal in the operation in the first mode.

(Mode B)

Next, an operation in the FSRD signal in the mode B will be described. The FSRD signal outputted only once in the high-level state within the half-wave of the same power control object is outputted for the t5 second on the basis of the falling or the rising of the zero-cross signal after the correction. That is, this FSRD signal is in a state similar to the state of the first FSRD signal in the operation in the mode A. By making such setting, in the operation in the mode B in the embodiment 2, the FSRD signal with the high-level state time of t5 is outputted once within one half-wave, so that the cumulative time in which the gate current Ig flows within the one half-wave is t5×1. The FSRD signal outputted once in the high-level state for the t5 second is a signal in the operation in the second mode. In the mode B, in the one half-wave, the cumulative time in which the gate current Ig flows is t5, and is shorter than the cumulative time (t5×2) in which the gate current Ig flows in the mode A (t5<t5×2). In general, control is carried out in the operation in the mode A, but in the embodiment 2, when the value of the charge and discharge counter p becomes the operation mode switching threshold Pth1 or more, the FSRD signal is changed to the FSRD signal in the operation in the mode B.

(Heater Current)

In FIG. 7, in the case of the operation in the mode A, the heater current I starts to flow in interrelation with the zero-cross signal after the correction at timing when the FSRD signal is outputted in the high-level state for t5=2.0 ms. After the triac 56 is turned on and the heater current I starts to flow, the heater current I continuously flows until a subsequent zero-cross point of the AC voltage source 100. Further, also, in the case where the FSRD signal in the operation in the mode B is outputted, the heater current I flows in a manner similar to the manner in the case where the FSRD signal in the operation in the mode A is outputted.

[Timing Chart]

Figure 8:
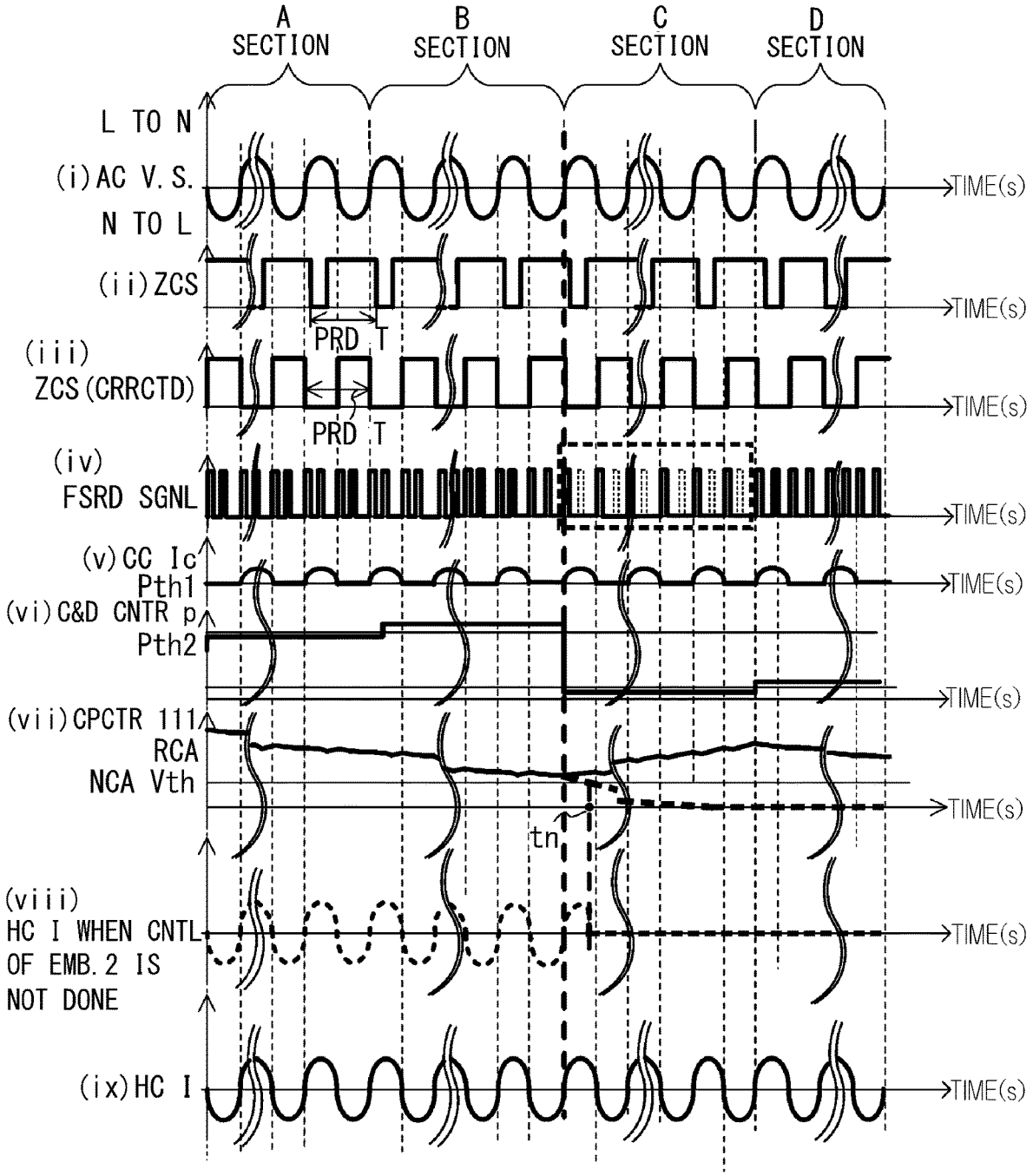
FIG. 8 is a timing chart showing the control of the heater in the embodiment 2.

FIG. 8 includes timing charts of entirety of control. Further, part (i) to (ix) of FIG. 8 shows waveforms similar to the waveforms of parts (i) to (ix) of FIG. 5, and therefore will be omitted from description. In FIG. 8, sections A to D show a state in which the CPU 94 controls the heater current I by turning on and off the triac 56, and each of the sections A to D corresponds to one control unit (16 half-waves). In the sections A to D, the electric power supply level shown in the table 1(a) is 16 (supply ratio: 100%). The CPU 94 carries out control by using the 16 half-waves as the one control unit, and turns on the triac 56 by continuously controlling the FSRD signal over 16 half-waves in each of the sections A to D, so that the CPU 94 supplies the heater current I to the heater 54.

(Case where Control of Embodiment 2 is not Carried Out)

In the case where control of the embodiment 2 is not carried out, operations of the FSRD signal (part (iv)), the remaining electric charge amount (part (vii)) and the heater current I (part (viii)) are shown by broken lines in FIG. 8. In the case where the control of the embodiment 2 is not carried out, i.e., in the case where the operation in the mode A is always performed without switching the operation mode, the FSRD signal is continuously outputted in the high-level state for t5 second twice within the half-wave of the same power control object depending on the control table of the table 1(a). In this case, the remaining electric charge amount of the capacitor 111 continuously decreases during output of the FSRD signal in the high-level state in the sections A and B. In the section C, when the FSRD signal is continuously outputted similarly as in the sections A and B, the remaining electric charge amount of the capacitor 111 is below the necessary electric charge amount Vth necessary to pass the gate current Ig of the triac 56 at timing of a time instance tn. For this reason, from the time instance tn on, even when the FSRD signal is outputted, the necessary gate current Ig does not flow, so that the triac 56 cannot be turned on. When the triac 56 cannot be turned on, the heater current I also does not flow.

(Case where Control of Embodiment 2 is Carried Out)

In the case where the control of the embodiment 2 is carried out, the operations of the FSRD signal (part (iv)), the remaining electric charge amount of the capacitor 111 (part (vii)), and the heater current I (part (viii)) are shown by solid lines in FIG. 8. In the embodiment 2, similarly as in the embodiment 1, the CPU 94 predicts (estimates) the remaining electric charge amount of the capacitor 111 by using the charge and discharge counter p. In the case where the value of the charge and discharge counter p is the operation mode switching threshold Pth1 or more, the CPU 94 discriminates that the remaining electric charge amount of the capacitor 111 is small and switches the operation mode from the mode A to the mode B, so that the number of outputs of the FSRD signal within the half-wave of the same power control object is decreased from 2 to 1. Then, the remaining electric charge of the capacitor 111 is increased through the charge, and in the case where the value of the charge and discharge counter p is the operation mode switching threshold Pth2 or less, the CPU 94 predicts that the remaining electric charge of the capacitor 111 is sufficiently increased. The CPU 94 switches the operation mode from the mode B to the mode A, so that the number of outputs of the FSRD signal within the half-wave of the same power control object is returned to 2.

[Charging and Discharging Counter p]

A specific operation of the charge and discharge counter p in the embodiment 2 will be described. Here, the electric power supply level is set at 16, and therefore, from the table 1(a), the increment in the case of the mode A is +3, and the increment in the case of the mode B is −40. The value of the charge and discharge counter p is 45 in an initial state at the time of a start of the section A in an example shown in FIG. 8. As shown in the above-described table 1(a), the increment at the electric power supply level 16 is 3, so that the value of the charge and discharge counter p is incremented by 3 in each of the sections A and B, i.e., incremented by 6 in total, and thus results in 51. The operation mode switching threshold Pth1 and the operation mode switching threshold Pth2 are values determined in advance similarly as in the embodiment 1, and in the embodiment 2, Pth1=50 and Pth2=15 are determined in advance.

In the section B, the value of the charge and discharge counter p is 51 and thus exceeds the operation mode switching threshold Pth1=50. When the value of the charge and discharge counter p exceeds the operation mode switching threshold Pth1=50. When the value of the charge and discharge counter p exceeds the value of the operation mode switching threshold Vthl, the CPU 94 switches the operation mode to the mode B, and outputs only once the FSRD signal in the high-level state within the half-wave of the same power control object. Then, the value of the charge and discharge counter p in the section C becomes 11 (=51−40) by being incremented by −40 (decremented by 40) which is the value shown in the table 1(a), and thus is below the value of the operation mode switching threshold Pth2=15. When the value of the charge and discharge counter p is below the operation mode switching threshold Pth2, the CPU 94 returns the operation mode to the mode A in the section D. By this, in the section D, similarly as in the sections A and B, the CPU 94 outputs twice the FSRD signal in the high-level state for t5=2.0 ms within the half-wave of the power control object, so that the charge and discharge counter p is incremented by (+)3. Thereafter, the operation similar to the above-described operation is represented.

[Residual Electric Charge Amount of Capacitor]

Next, an operation of the remaining electric charge amount of the capacitor 111 in the case where the control of the embodiment 2 is carried out will be described. The remaining electric charge amount of the capacitor 111 is continuously decreased during output of the FSRD signal similarly as in the embodiment 1 in the sections A and B in which the operation state is the state of the mode A. In the section C, the value of the charge and discharge counter p exceeds the operation mode switching threshold Pth1, and therefore, the operation mode is changed from the mode to the mode B. The FSRD signal is outputted only once, from the falling or the rising of the zero-cross signal after the correction, in the high-level state within the half-wave of the same power control object. When the ON mode is changed to the mode B, a discharge amount of the capacitor 111 within the half-wave of the same power control object decreases. Then, in the section C, the charging current Ic (part (v)) flows through the capacitor 111 and thus the capacitor 111 is charged, so that the remaining electric charge amount increases. Further, in the section C, the value of the charge and discharge counter p is incremented by −40 (decremented by 40) and thus is below the operation mode switching threshold Pth2 (=15), so that the operation mode is changed from the mode B to the mode A. Then, in the section 8, an output method of the FSRD signal returns to the state of the mode A. Thereafter, a similar operation is repeated.

[Heater Current]

Finally, displacement of the heater current in the case where the control of the embodiment 2 is carried out is shown by a solid line in part (ix) of FIG. 8. In the sections A and B, and thereafter, the heater current I continuously flows to a subsequent zero-cross point of the AC voltage source. Further, as described above, also in the section C, the remaining electric charge amount is not below the necessary electric charge amount Vth to pass the gate current Ig of the triac 56, so that the remaining electric charge amount can be maintained. For this reason, even in the sections C and D, after the FSRD signal is outputted in the high-level state, the heater current I flows to a subsequent zero-cross point of the AC voltage source 100. Thereafter, by carrying out similar control, the connect can be continued while substantially continuously subjecting the triac 56 to ON/OFF control.

[Flowchart]

Figure 9:
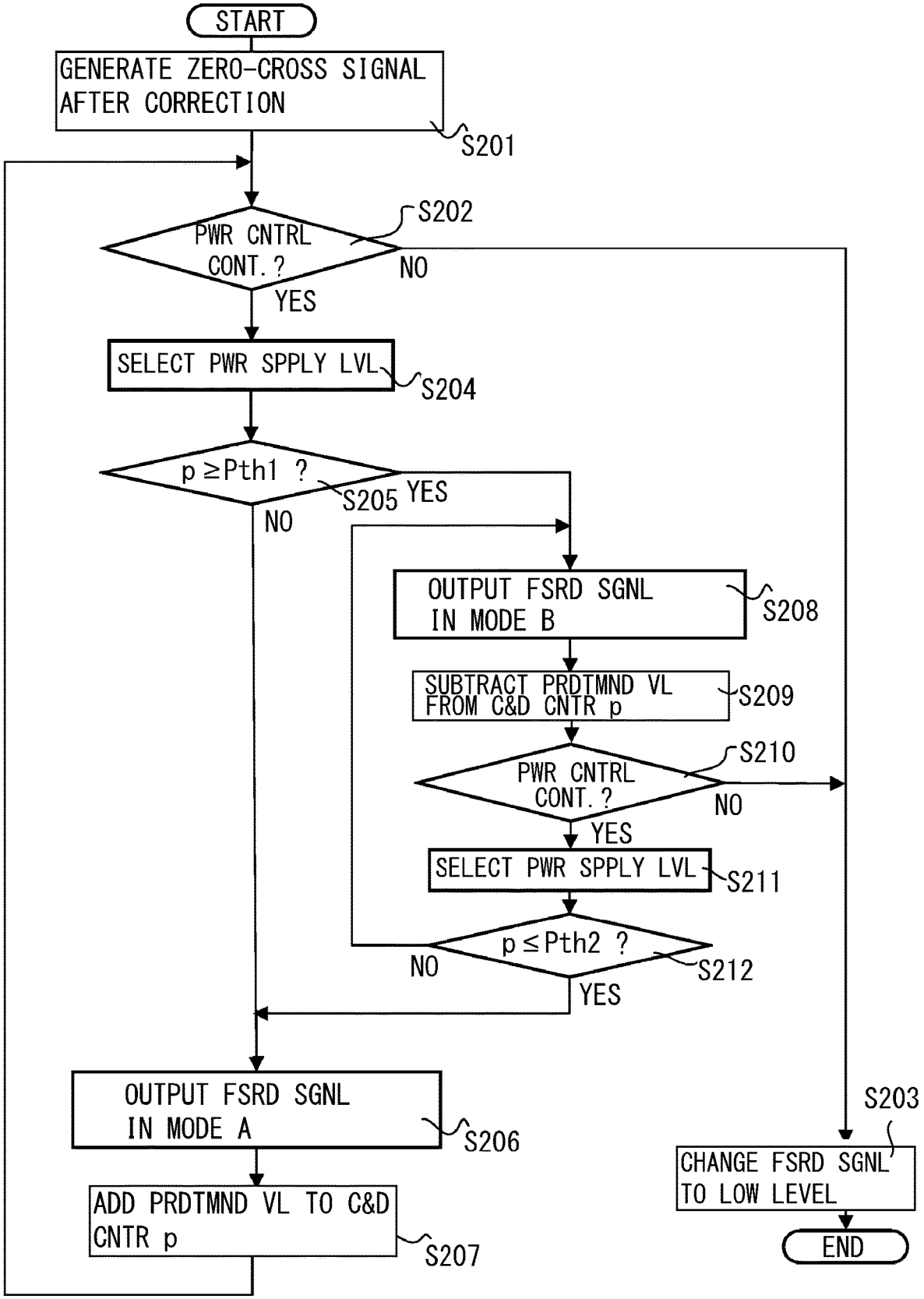
FIG. 9 is a flow chart showing the control of the heater in the embodiment 2.

FIG. 9 is a flow chart showing an electric power control process of the heater 54 by the CPU 94. A difference from the embodiment 1 is as follows. First, the electric power supply level is selected from the electric power supply table (electric power supply levels) of the 16 half-wave periods shown in the above-described table 1(a), and control of the electric power supplied to the heater 54 is determined. Further, depending on the selected electric power supply level, the increment and the decrement of the charge and discharge counter p are determined. Further, the output method of the FSRD signal includes two kinds consisting of the mode A and the mode B. Other constitutions are similar to those in the embodiment 1. Incidentally S201 to S203, S205, 5207, S209, S210, and S212 in FIG. 9 are similar to S101 to S104, S106, and S108 to S110, respectively, and will be omitted from description. In the case where the CPU 94 discriminated in S202 that the electric power control is continued, in S204, the CPU 94 selects the electric power supply level described in the table 1(a). In the case where the CPU 94 discriminated in S205 that the value of the charge and discharge counter p is less than the operation mode switching threshold Pth1, in S206, the CPU 94 switches the operation mode to the mode A. In the mode A, the CPU 94 outputs the FSRD signal in the high-level state on the basis of the falling or the rising of the zero-cross signal after the correction, and puts the triac 56 in the ON state, and thus supplies the electric power to the heater 54.

In the case where the CPU 94 discriminated in S205 that the value of the charge and discharge counter p is the operation mode switching threshold Pth1 or more, in S208, the CPU 94 switches the operation mode to the mode B. The CPU 94 outputs the FSRD signal in the high-level state in the mode B on the basis of the falling or the rising of the zero-cross signal after the correction and puts the triac 56 in the ON state, and thus supplies the electric power to the heater 54. In S210, in the case where the CPU 94 discriminated that the electric power control to the heater 54 is continued, in S211, the CPU 94 selects the electric power supply level described in the table 1(a).

By carrying out the control described above, in the case where sufficient electric charge is accumulated in the capacitor 111, the FSRD signal is outputted plural times in the high-level state for a predetermined long time within the half-wave of the same power control object. On the other hand, in the case where the electric charge accumulated in the capacitor 111 is insufficient, the FSRD signal is outputted only one, through reduction in the number of outputs, for a predetermined time within the half-wave of the same power control object, so that the remaining electric charge of the capacitor 111 is maintained or charged. As described above, the CPU 94 turns on the triac 56 and passes the gate current Ig while outputting plural times in the high-level state within the half-wave of the same power control object. Further, even when the triac 56 is turned off due to the noise and the distortion of the AC voltage source 100, the triac 56 can be turned on again. Further, in the case where the gate current Ig of the triac 56 is passed plural times within the half-wave of the same power control object in a cumulating manner of a predetermined number of times, the CPU 94 predicts that the electric charge of the capacitor 111 decreases. Then, the CPU 94 changes the number of outputs of the FSRD signal in the high-level state to one. The CPU 94 decreases a total time in which the gate current Ig of the triac 56 flows within the half-wave of the same power control object, and continuously carries out the ON/OFF control of the triac 56 while maintaining the electric charge amount of the capacitor 111.

By doing so, without adding a circuit component part causing an increase in cost the triac 56 can be substantially continuously subjected to the control by a simple means while avoiding the influence due to the distortion and the noise of the AC voltage. Incidentally, a constitution in which the increment and the decrement are determined depending on the electric power supply level may also be applied to the embodiment 1 (constitution in which the time of the high-level state is switched between the t3 and the t4.

As described above, according to the embodiment 2, in the circuit in which the switching element is controlled by the voltage source other than the AC voltage source, while suppressing the increase in cost, the influence due to the distortion and the noise of the AC voltage is avoided by the simple means, so that it is possible to continuously control the switching element.

Embodiment 3

In the embodiment 1, the gate current Ig of the triac 56 was continuously passed for the long time to the extent possible within the half-wave of the same power control object in order to avoid the turning-off of the triac 56 by the influence of the noise superposed on the AC voltage source 100. Here, in the case where the electric charge of the capacitor 111 is decreased by cumulatively passing the gate current Ig of the triac 56 a predetermined number of times, a constitution in which the time when the gate current Ig is passed is decreased and thus the electric charge of the capacitor 111 is maintained is employed. In an embodiment 3, an input voltage detecting means for the AC voltage source 100 is provided, and the AC voltage of the AC voltage source 110 is detected, whereby prediction accuracy of the charging electric charge amount to the capacitor 111 is enhanced. By this, the triac 56 is subjected to the ON/OF control while predicting the remaining electric charge amount of the capacitor 111 with accuracy. A timing chart and an operation are similar to those in the above-described embodiment 1, and will be omitted from description in the embodiment 3.

[Circuit Constitution and Operation]

Figure 10:
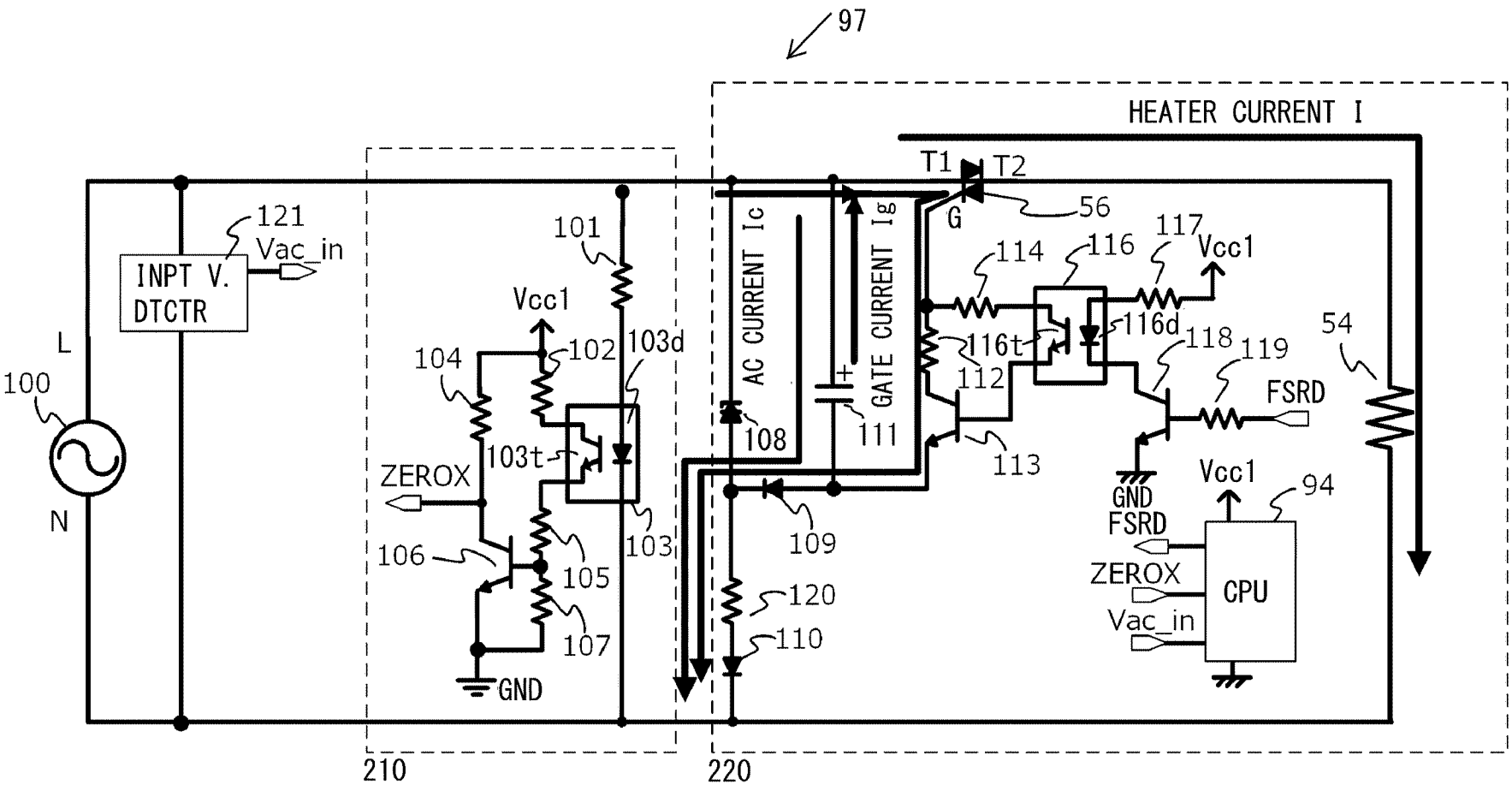
FIG. 10 is a schematic view showing entirety of a circuit constitution of a fixing device in the embodiment 3.

FIG. 10 is a schematic view of entirety of the electric power controller 97 in the embodiment 3. This embodiment is similar to the embodiment 1 except that an input voltage detecting portion 121 which is the input voltage detecting means is provided. The input voltage detecting portion 121 detects an effective voltage value of the AC voltage source 100. The input voltage detecting portion 121 detects a voltage inputted from the AC voltage source 100 to the electric power controller 97 and outputs the inputted effective voltage value, as a Vac_in(rms) signal, which is a detection result, to the CPU 94. The CPU 94 carries out control described later on the basis of the inputted Vac_in (rms) signal.

[Relationship Between Inputted Voltage Value and Charge and Discharge Counter]

TABLE 2

| IEVV*[1]Vac_in(rms) | CDC*[2] p | |
|---|---|---|
| (Vrms) | BEFORE FSC*[3] | AFTER FSC*[3] |
| 140≤ | INPUT VOLTAGE ABNORMALITY | |
| 120 ≤ & < 140 | +1 | −40 |
| 110 ≤ & < 120 | +1 | −30 |
| 100 ≤ & < 110 | +1 | −20 |
| 85 ≤ & < 100 | +1 | −10 |
| <85 | INPUT VOLTAGE ABNORMALITY | |

*[1]"IEVV" is the inputted effective voltage value.
*[2]"CDC" is the charge and discharge counter.
*[3]"FSC" is FSRD signal change.

A table 2 is a table showing values with which the CPU 94 increments or decrements the charge and discharge counter p with respect to the inputted effective voltage value of the AC voltage source 100, which is a detection result of the input voltage detecting portion 121. In the table 2, a first column represents values of the inputted effective voltage value detected by the input voltage detecting portion 121, and a second column represents an increment (+) of the charge and discharge counter p before FSRD signal change and increments (−) of the charge and discharge counter p after the FSRD signal change.

When an operation guaranteed range is 85 Vrms to 140 Vrms, in a range from 85 Vrms (or more) to less than 140 V rms, the value of the charge and discharge counter p is incremented by (+) 1 in the case where the FSRD signal is outputted (turned on) in the high-level state for the t2 second as in the embodiment 1. In the case where the FSRD signal is turned on in the high-level state for the t2 second as in the embodiment 1, when the inputted effective voltage value Vac_in(rms) is 120 rms or more and less than 140 Vrms, the value of the charge and discharge counter p is incremented by −40 (decremented by 40). Further, when the inputted effective voltage value Vac_in(rms) is 110 Vrms or more and less than 120 Vrms, the value of the charge and discharge counter p is incremented by −30 (decremented by 30). when the inputted effective voltage value Vac_in(rms) is 100 rms or more and less than 110 Vrms, the value of the charge and discharge counter p is incremented by −20 (decremented by 20). Further, when the inputted effective voltage value Vac_in(rms) is 85 Vrms or more and less than 100 Vrms, the value of the charge and discharge counter p is incremented by −10 (decremented by 10). Thus, the decrement of the charge and discharge counter p after the CPU 94 discriminates that the remaining electric charge amount of the capacitor 111 is insufficient and changes the FSRD signal is made smaller with a lower inputted effective voltage value Vac_in(rms) (i.e., made larger with a higher inputted effective voltage value Vac_in(rms). In the case where the inputted effective voltage value Vac_in(rms) is less than 85 Vrms or 140 Vrms or more, this inputted effective voltage value is out of the operation guaranteed range, and therefore, the CPU 94 discriminates that input voltage abnormality occurs and interrupts the above-described pieces of control.

[Flowchart]

Figure 11:
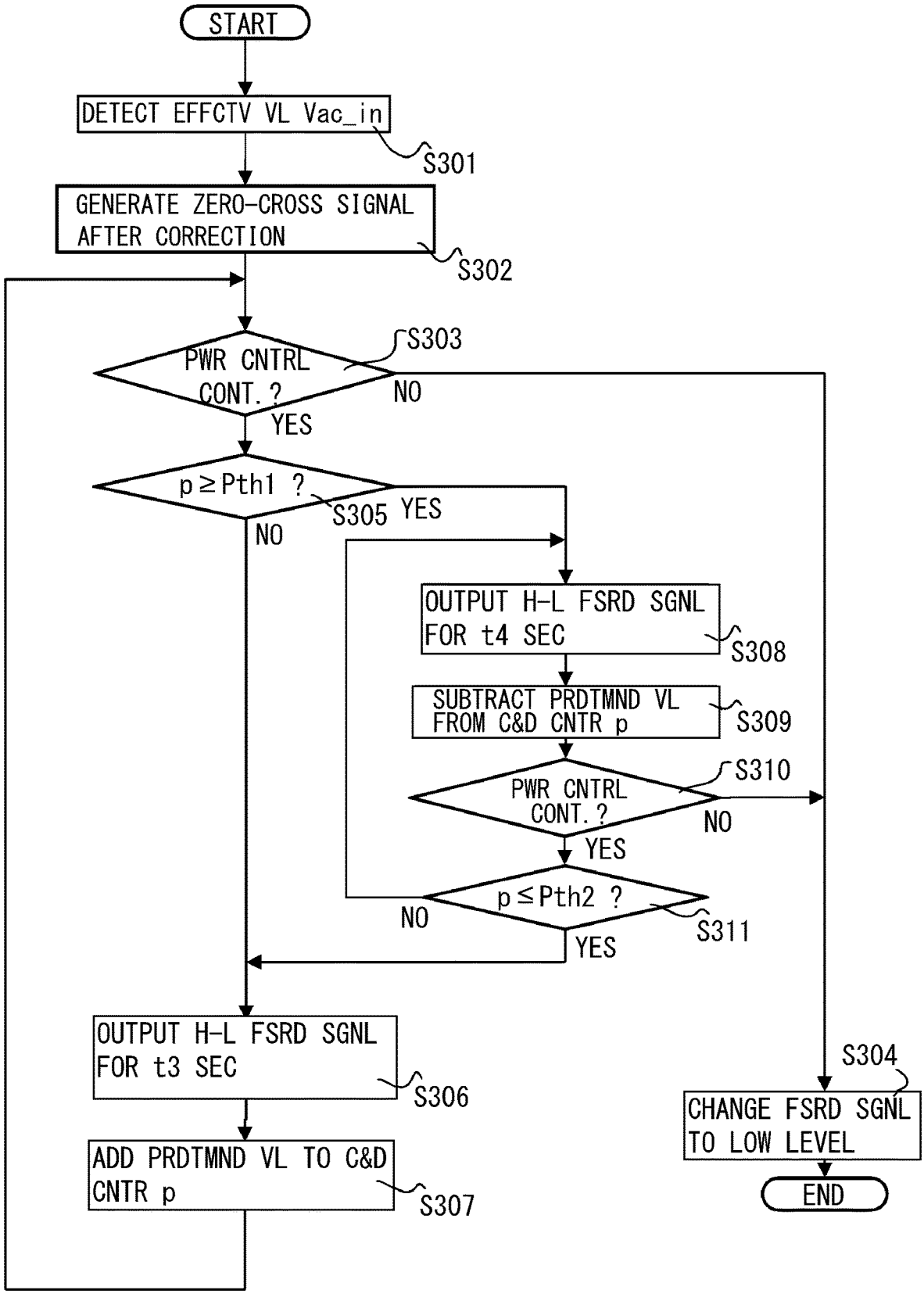
FIG. 11 is a flowchart showing control of a heater in the embodiment 3.

FIG. 11 is a flow chart showing an electric power control process of the heater 54 by the CPU 94. Incidentally, processes of S302 to S311 are similar to the processes S101 to S110 of FIG. 5, respectively, and therefore, will be omitted from description. In S301, the CPU 94 receives the inputted effective voltage value Vac_in(rms) of the AC voltage source 100 detected by the input voltage detecting portion 121, and determines the increment and the decrement of the charge and discharge counter p on the basis of the table 2. Incidentally, a predetermined value when the predetermined value is incremented to the charge and discharge counter p in S307 is an increment determined in S301 on the basis of the detected inputted effective voltage value Vac_in(rms) and the table 2. Further, a predetermined value when the predetermined value is decremented from the charge and discharge counter p in S309 is a decrement determined in S301 on the basis of the detected inputted effective voltage value Vac_in(rms) and the table 2.

By carrying out the control in the embodiment 2, in the case where sufficient electric charge is accumulated in the capacitor 111, the FSRD signal is outputted in the high-level state for a long time to the extent possible (for example, t3) within the half-wave of the same power control object. On the other hand, in the case where the electric charge accumulated in the capacitor 111 is insufficient, a time in which the FSRD signal is outputted in the high-level state within the half-wave of the same power control object is decreased, so that the remaining electric charge of the capacitor 111 is maintained increased through charging of the electric charge. As described above, in order to prevent turning-off of the triac 56 due to the noise and the distortion of the AC voltage of the AC voltage source 100, the gate current Ig of the triac 56 is continuously passed for a long time to the extent possible within the half-wave of the same power control object. Thus, the turning-off of the triac 56 due to the noise and the distortion of the AC voltage source 100 is prevented. In the case where the gate current Ig of the triac 56 is continuously passed for a long time to the extent possible within the half-wave of the same power control object in a cumulative manner of a predetermined number of times, the CPU 94 predicts that the electric charge of the capacitor 111 decreases. Then, the CPU 94 decreases the time in which the gate current Ig is passed, and thus maintains the remaining electric charge amount of the capacitor 111 which is the voltage source or increases the remaining electric charge amount through the charging of the electric charge. Further, the CPU 94 detects the input voltage of the AC voltage source 100 and carries out the above-described control while accurately predicting (estimating) an electric charge decreasing amount or a charged electric charge amount of the capacitor 111 depending on the detected input voltage.

By doing so, without adding a circuit component part causing an increase in cost the triac 56 can be substantially continuously subjected to the control by a simple means while avoiding the influence due to the distortion and the noise of the AC voltage. Incidentally, a constitution in which the increment and the decrement of the charge and discharge counter p are determined depending on the inputted effective voltage value Vac_in(rms) in the embodiment 3 may also be applied to the constitution of the embodiment 2 in which the increment and the decrement of the charge and discharge counter p are determined depending on the electric power supply level.

As described above, according to the embodiment 3, in the circuit in which the switching element is controlled by the voltage source other than the AC voltage source, while suppressing the increase in cost, the influence due to the distortion and the noise of the AC voltage is avoided by the simple means, so that it is possible to continuously control the switching element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-088952 filed on May 21, 2020, which is hereby incorporated by reference herein in its entirety.

What is claimed is:

1. A fixing device comprising:

a heater;

a switching element configured to switch a state thereof between a conduction state in which electric power is supplied from an AC voltage source to said heater and a non-conduction state in which supply of the electric power is interrupted;

a zero-cross detecting portion configured to detect a zero-cross point of an AC voltage supplied from the AC voltage source;

a controller configured to control said switching element to the conduction state or the non-conduction state on the basis of a detection result of said zero-cross detecting portion;

a power source chargeable by the electric power supplied from the AC voltage source and configured to supply, to said switching element, a current for changing the state of said switching element from the non-conduction state to the conduction state; and a driving portion configured to change the state of said switching element to the non-conduction state by supplying the current from said power source to said switching element depending on a signal outputted from said controller, wherein in a case that an amount of electric charge charged in said power source is predetermined value or more, said controller outputs a first signal to said driving portion so that a time in which a current is passed from said power source to said switching element is a first time, and in a case that the amount of the electric charge is less than the predetermined value, said controller outputs a second signal to said driving portion so that the time in which the current is passed from said power source to said switching element is a second time shorter than the first time.

2. A fixing device according to claim 1, wherein said controller outputs the first signal or the second signal to said driving portion in a period corresponding to a single half-wave of the AC voltage supplied from the AC voltage source.

3. A fixing device according to claim 2, wherein in the period corresponding to the single half-wave of the AC voltage supplied from the AC voltage source, in a case that the amount of electric charge charged in said power source is the predetermined value or more, said controller outputs a third signal to said driving portion plural times so that the time in which the current is passed from said power source to said switching element is a third time different from the first time, and in a case that the amount of electric charge is less than the predetermined value, said controller outputs the third signal to said driving portion once.

4. A fixing device according to claim 2, further comprising a predicting portion configured to predict the amount of electric charge charged in said power source, wherein said predicting portion includes a counter which is incremented when said controller outputs the first signal to said driving portion and which is decremented when said controller outputs the second signal to said driving portion, wherein said predicting portion predicts that the amount of electric charge is insufficient in a case that said counter indicates a first threshold or more and predicts that the amount of electric charge is not insufficient in a case that said counter indicates less than the first threshold, and wherein in a case that said predicting portion predicts that the amount of electric charge is insufficient, when said counter indicates not more than a second threshold lower than the first threshold, said predicting portion predicts that the amount of electric charge is not insufficient.

5. A fixing device according to claim 4, wherein said controller controls said driving portion on the basis of a supply amount of the electric power depending on a target temperature of said heater, and wherein an increment value and a decrement value of said counter are determined depending on the supply amount of the electric power.

6. A fixing device according to claim 5, wherein the first threshold is larger with an increasing supply amount of the electric power, and wherein the second threshold is smaller with the increasing supply amount of the electric power.

7. A fixing device according to claim 4, further comprising voltage detecting means for detecting the voltage of said AC voltage source, wherein the first threshold and the second threshold are determined on the basis of a detection result of said voltage detecting means.

8. A fixing device according to claim 7, wherein the second threshold is larger with an increasing voltage detected by said voltage detecting means.

9. A fixing device according to claim 1, wherein said switching element is a bidirectional thyristor, and wherein said driving portion supplies a current to a gate terminal of said bidirectional thyristor from said power source depending on a signal outputted from said controller.

10. An image forming apparatus for forming a toner image on a recording material, comprising:

an image forming portion configured to form the toner image on the recording material; and a fixing device configured to fix the toner image formed on the recording material, wherein said fixing device comprises:

a heater;

a switching element configured to switch a state thereof between a conduction state in which electric power is supplied from an AC voltage source to said heater and a non-conduction state in which supply of the electric power is interrupted;

a zero-cross detecting portion configured to detect a zero-cross point of an AC voltage supplied from the AC voltage source;

a controller configured to control said switching element to the conduction state or the non-conduction state on the basis of a detection result of said zero-cross detecting portion;

a power source chargeable by the electric power supplied from the AC voltage source and configured to supply, to said switching element, a current for changing the state of said switching element from the non-conduction state to the conduction state; and a driving portion configured to change the state of said switching element to the non-conduction state by supplying the current from said power source to said switching element depending on a signal outputted from said controller, wherein in a case that an amount of electric charge charged in said power source is predetermined value or more, said controller outputs a first signal to said driving portion so that a time in which a current is passed from said power source to said switching element is a first time, and in a case that the amount of the electric charge is less than the to predetermined value, said controller outputs a second signal to said driving portion so that the time in which the current is passed from said power source to said switching element is a second time shorter than the first time.

* * * * *